US007523905B2

(12) United States Patent
Timm et al.

(10) Patent No.: US 7,523,905 B2
(45) Date of Patent: Apr. 28, 2009

(54) HEIGHT AND TILT ADJUSTABLE KEYBOARD SUPPORT

(75) Inventors: Derek Timm, Windsor, CA (US); Giancarlo A. Giustina, Petaluma, CA (US); Matthew R. Vargas, San Jose, CA (US)

(73) Assignee: Workrite Ergonomics, Inc., Petaluma, CA (US)

( * ) Notice: Subject to any disclaimer, the term of this patent is extended or adjusted under 35 U.S.C. 154(b) by 449 days.

(21) Appl. No.: 11/336,737

(22) Filed: Jan. 20, 2006

(65) Prior Publication Data

US 2007/0170326 A1 Jul. 26, 2007

(51) Int. Cl.
*E04G 3/00* (2006.01)
*A47F 5/00* (2006.01)

(52) U.S. Cl. ..... 248/284.1; 248/281.11; 248/278.1; 248/918; 108/69; 108/75; 108/138

(58) Field of Classification Search ..... 248/181.11, 248/284.1, 278.1, 291.1, 292.12, 918, 917, 248/279.1, 286.1; 108/238, 145, 139, 140, 108/141, 69, 75, 71; 312/28

See application file for complete search history.

(56) References Cited

U.S. PATENT DOCUMENTS 5,145,136 A 9/1992 McConnell
5,292,097 A 3/1994 Russell (Continued)

OTHER PUBLICATIONS

Photographs of Sunway CML keyboard tray system, part No. CML409BK manufactured by Sunway Inc., Centuria WI 54824. Upon Information and Belief, the Sunway CML Keyboard Tray system, part No. CML409BK is prior art to Applicants' invention (12 pages).

(Continued)

*Primary Examiner*—Amy J. Sterling
*Assistant Examiner*—Tan Le
(74) *Attorney, Agent, or Firm*—Tarolli Sundheim Covell & Tumming LLP

(57) ABSTRACT

A keyboard support for movably supporting a keyboard with respect to a work surface of a workstation. The keyboard support includes a workstation engaging member adapted to be attached to an underside of the work surface, a keyboard engaging member for supporting a keyboard, and a linkage assembly mechanically coupling and providing relative movement between the workstation engaging member and the keyboard engaging member and thereby between the keyboard and the work surface. The keyboard support also includes a braking assembly adapted to allow relative movement of the keyboard engaging member with respect to the workstation engaging member in an unlocked position and to prevent relative movement of the keyboard engaging member with respect to the workstation engaging member in a locked position. The braking assembly comprises a roller assembly carried on a connector of the linkage assembly. The roller assembly is biased against a wedge affixed to a vertical side of the keyboard engaging member.

17 Claims, 16 Drawing Sheets

U.S. PATENT DOCUMENTS 5,881,984 A * 3/1999 Lin ..... 248/284.1
5,924,664 A * 7/1999 Mileos et al. ..... 248/281.11
6,021,985 A * 2/2000 Hahn ..... 248/286.1
6,450,467 B2 * 9/2002 Timm ..... 248/284.1
6,883,764 B1 * 4/2005 Mileos et al. ..... 248/281.11
6,905,102 B2 * 6/2005 Lin ..... 248/285.1
6,929,228 B2 * 8/2005 Whitaker et al. ..... 248/284.1
7,188,813 B2 * 3/2007 Kollar ..... 248/279.1
7,198,239 B2 * 4/2007 Mileos et al. ..... 248/281.11
2001/0035482 A1 * 11/2001 Timm ..... 248/284.1
2007/0170326 A1 * 7/2007 Timm et al. ..... 248/281.11

OTHER PUBLICATIONS

Sunway CML Keyboard Tray System with Slide-out Mouse Tray. Product Listing [online]. Sunway, Inc., Centuria, Washington [retrieved on Apr. 17, 2007]. Retrieved from the Internet: <URL: www.sunwayinc.com/product.php?productid=45&cat=6&page=1> 4 pages.

* cited by examiner

HEIGHT AND TILT ADJUSTABLE KEYBOARD SUPPORT

FIELD OF THE INVENTION

The present invention relates to a keyboard support attachable to an underside of a workstation work surface and, more particularly, to a keyboard support providing both height and tilt adjustment of a keyboard with respect to the work surface.

BACKGROUND OF THE INVENTION

Various keyboard support designs have been proposed for movably supporting a computer keyboard which is part of a computer workstation. Generally, the workstation includes a work surface that supports a computer monitor. The keyboard support typically includes a workstation engaging member, a keyboard engaging member, and a mechanical linkage between the workstation engaging member and the keyboard engaging member.

The workstation engaging member is attached to an underside of the work surface and the keyboard engaging member supports a planar keyboard support surface on which the keyboard is disposed. The linkage permits relative movement of the keyboard engaging member with respect to the workstation engaging member.

For ergonomic reasons, it is desirable the keyboard support surface be adjustable both in terms of vertical position or height and orientation or tilt angle with respect to the work surface. Various designs have been proposed for keyboard supports wherein the keyboard support surface has both height and tilt angle adjustability with respect to a work surface. One such design is disclosed in U.S. Pat. No. 6,450,467 to Timm, which is assigned to the assignee of the present invention. The '467 patent is incorporated herein in its entirety by reference. Other examples of keyboard supports include the supports disclosed in U.S. Pat. No. 5,145,136 to McConnell and U.S. Pat. No. 5,881,984 to Lin.

One area of continuing attention and potential improvement is that of the braking assembly of a keyboard support. The braking assembly of a keyboard support allows a user of the keyboard support to move the keyboard support surface (and thereby the keyboard) to a desired height relative to the work surface and then lock the support at the desired height. The braking assembly may also allow the user to adjust the tilt angle of the keyboard support surface. The braking mechanism must be easy to use allowing a user to easily adjust the keyboard support surface to a desired height and, at the same time, must have a positive locking capability such that once the keyboard support surface is at the desired height and in the locked position, pressure applied to the keyboard during use will not cause the support to move.

Additionally, the braking mechanism must be rugged, since the keyboard support surface extends outwardly and away from the workstation work surface and, therefore, is prone to being hit or bumped by the user or others in the area. Further, the keyboard support must be durable. While a user may expect his or her computer system to be replaced every few years because of technological advances, a user will generally expect a keyboard support to last for many years. Finally, since a keyboard support is an extra cost, add-on feature to most computer workstations, it must be economical and cost-effective to manufacture such that the keyboard support can be competitively priced.

What is needed is a keyboard support that permits vertical height and tilt adjustment of the keyboard support surface. What is also needed is a keyboard support with a braking assembly that provides easy vertical adjustment of the keyboard support surface and positive locking of the support surface once a desired height is ascertained. What is also needed is keyboard support wherein the braking assembly is durable. What is also needed is a keyboard support that is cost efficient to manufacture.

SUMMARY OF THE INVENTION

The present invention concerns a keyboard support for movably supporting a keyboard with respect to a work surface of a workstation. In one illustrated embodiment, the keyboard support includes a workstation engaging member adapted to be attached to an underside of the work surface, a keyboard engaging member for supporting a keyboard, a linkage assembly mechanically coupling and providing relative movement between the workstation engaging member and the keyboard engaging member and thereby between the keyboard and the work surface, and a braking assembly adapted to allow relative movement of the keyboard engaging member with respect to the workstation engaging member in an unlocked position and to prevent relative movement of the keyboard engaging member with respect to the workstation engaging member in a locked position.

The keyboard engaging member includes a generally planar keyboard support surface whose position and orientation are controlled to control a position and orientation of the keyboard with respect to the work surface of the workstation. The keyboard engaging member includes two parallel side pieces spaced apart by and extending rearwardly from a center section. Extending above the center section is the keyboard support surface. The side pieces define aligned slots on opposite sides of the center section and aligned holes on opposite sides of the center section wherein the aligned holes are disposed vertically above the aligned slots.

The workstation engaging member is attachable to an underside of the work surface and includes two parallel side pieces spaced apart by a center section.

The linkage assembly includes a first support member having one end rotatably mounted to the workstation engaging member and including a body portion that extends away from the workstation engaging member at a controlled angle. The first support member includes an arcuate slot and a hole spaced from the arcuate slot at an end spaced from the end that is rotatably mounted to the workstation engaging member.

The linkage assembly further includes a second support member having one end rotatably mounted to the workstation engaging member and including a body portion that extends away from the workstation engaging member at a controlled angle. The second support member includes a hole at an end spaced from the end that is rotatably mounted to the workstation engaging member.

The linkage assembly further includes a first connector passing through the arcuate slot in the first support member, the aligned slots of the keyboard engaging member, and the hole passing through the second support member and a second connector passing through the aligned holes of the keyboard engaging member and the hole of the first support member.

The braking assembly includes a wedge and a roller assembly. The wedge is affixed to one side of the keyboard engaging member and includes a slot aligned with one of the arcuate slots of the keyboard engaging member. The wedge includes an inclined surface extending rearwardly from a higher end spaced further outwardly from the keyboard engaging member side to a lower end. The wedge slot extends along the inclined surface from near the higher end towards the lower end.

The roller assembly is carried on the first connector and includes at least one roller. The roller assembly is biased against the wedge for adjusting frictional force between the first and second support members, the further outwardly the roller assembly is urged the greater the pressure applied by the roller assembly against the wedge and the greater the frictional force between the first and second support members.

As the keyboard support surface is pivoted downwardly about the second connector, the wedge moves rearwardly. The roller assembly roller rolls along the inclined planar surface from a first unlocked position to a second locked position. When moving from the first unlocked position to the second locked position, the roller assembly is urged outwardly with respect to keyboard engaging member side, thereby applying increased pressure to the first and second support members to prevent relative movement between the keyboard engaging member and the workstation engaging member.

As the keyboard support surface is pivoted upwardly about the second connector, the wedge moves forwardly. The roller assembly roller rolls along the inclined planar surface from the second locked position to the first unlocked position. When moving from the second locked position to the first unlocked position, the roller assembly moves toward the keyboard engaging member side, thereby reducing pressure applied to the first and second support members and to allow relative movement between the keyboard engaging member and the workstation engaging member.

The roller assembly is biased against the wedge by a spring disposed between the roller assembly and a tilt adjustment knob threaded onto a threaded end of the first connector. To change an orientation or tilt angle of the keyboard support surface when the braking assembly is in the locked position, the keyboard support surface is pivoted slightly upwardly to a position intermediate a position of the keyboard support surface when the braking assembly is in the locked position and a position of the keyboard support surface when the braking assembly is in the unlocked position to slightly reduce the pressure applied by the roller assembly against the wedge. The tilt adjustment knob is then rotated. Rotating the tilt adjustment knob in a counterclockwise direction reduces a pressure of the roller on the wedge thereby tilting the keyboard support surface downwardly. Rotating the tilt adjustment knob in a clockwise direction increases the pressure of the roller on the wedge thereby tilting the keyboard support surface upwardly. The slight upward pivoting of the keyboard support surface reduces the frictional engagement braking forces sufficiently to permit movement of the roller along the wedge.

These and other objects, advantages, and features of the exemplary embodiment of the invention are described in detail in conjunction with the accompanying drawings.

DETAILED DESCRIPTION

Figure 1:
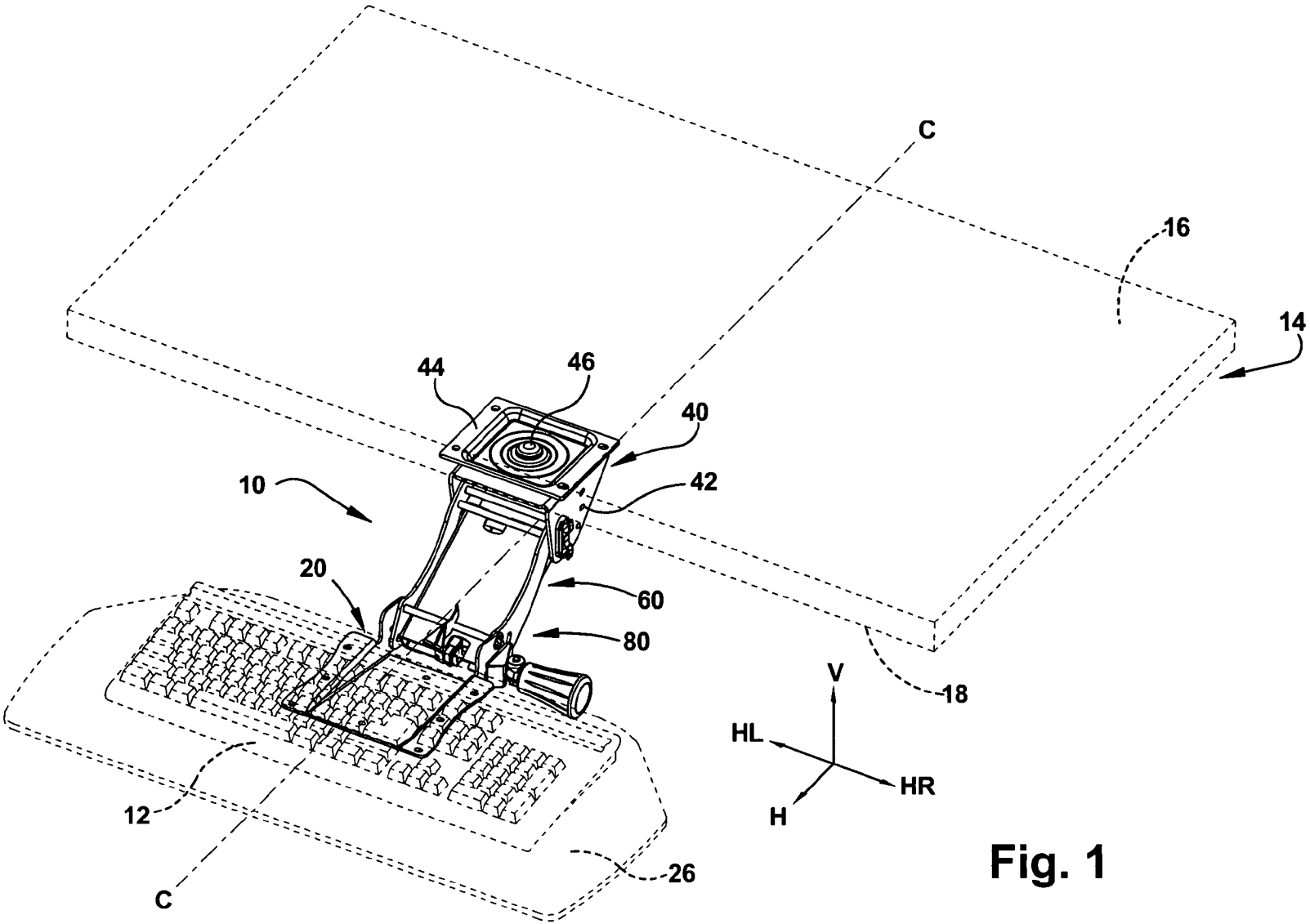
FIG. 1 is a perspective view of an adjustable keyboard support of the present invention.
Figure 2:
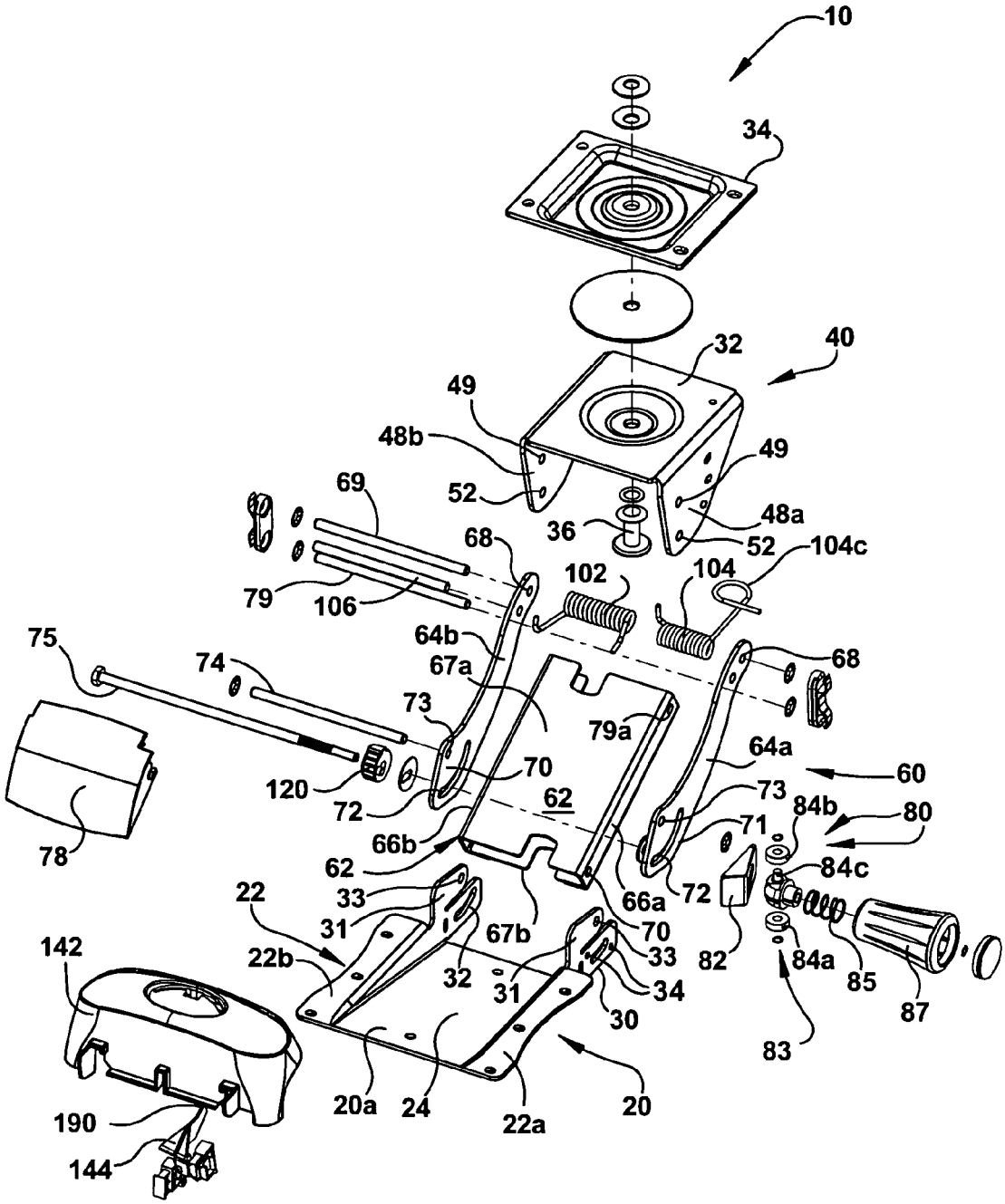
FIG. 2 is an exploded perspective view of the keyboard support of FIG. 1.
Figure 3:
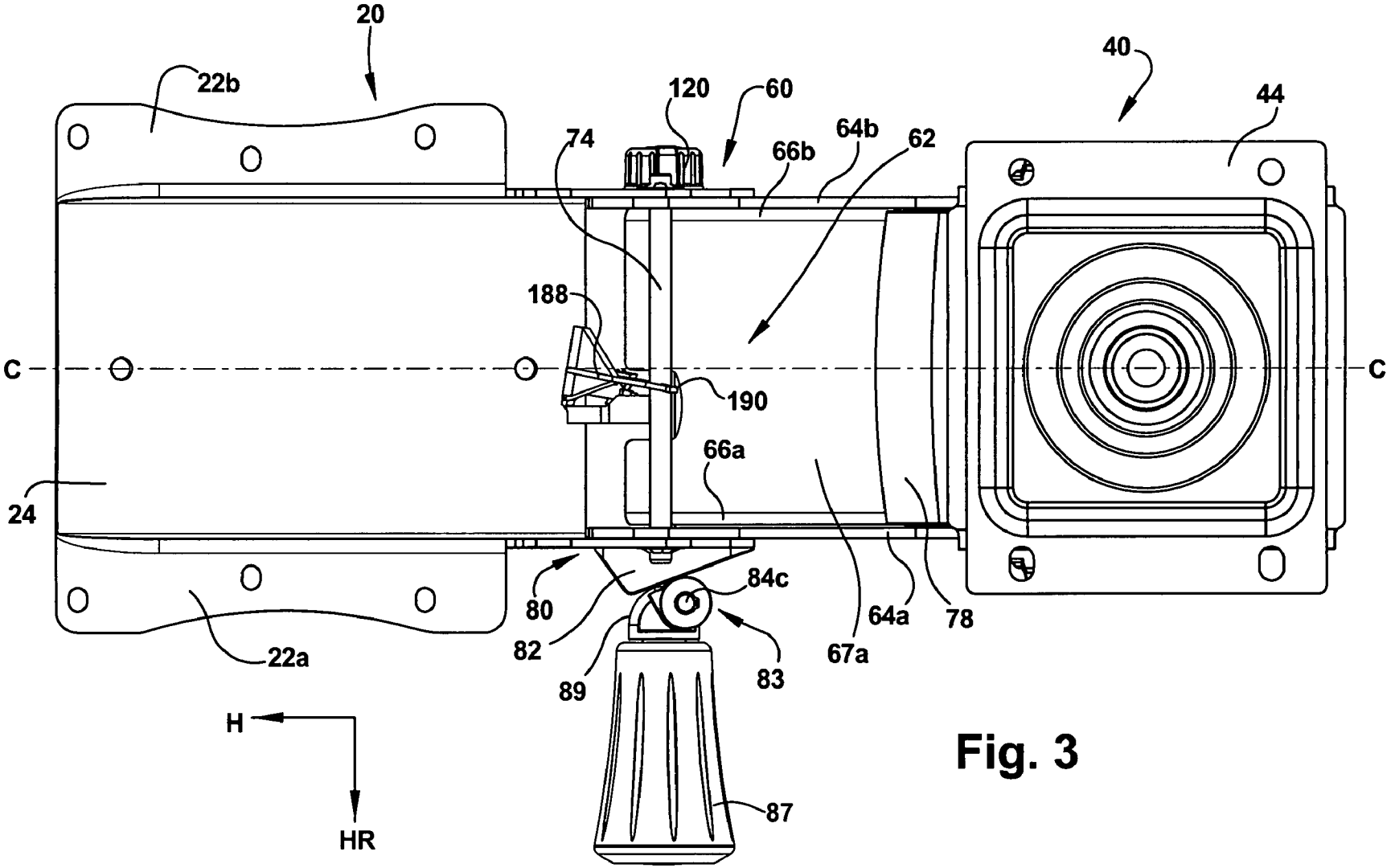
FIG. 3 is a top plan view of the keyboard support of FIG. 1.

FIG. 1 depicts a keyboard support 10 constructed in accordance with one exemplary embodiment of the present invention. The support 10 is intended to position a keyboard 12 with respect to a workstation such as a desk 14 (both shown in dashed line in FIG. 1). The support 10 includes a keyboard engaging member 20 movably coupled to a workstation engaging member 40 by a linkage assembly 60. The support 10 additional includes a braking assembly 80 to lock the keyboard engaging member 20, and thereby the keyboard 12, in a desired position with respect to the workstation engaging member 40 and to unlock or permit movement of the keyboard engaging member 20 with respect to the workstation engaging member 40.

For ease of description, but not by way of limitation, a forward direction will be presumed to be a horizontal direction H toward a user of the keyboard 12, a rearward direction will be opposite the forward direction. Outward to the right will mean a horizontal direction away from a centerline C-C through the support 10 to the user's right (shown as HR in FIG. 1), outward to the left will be opposite outward to the right (shown as HL in FIG. 1). Upward will be vertically upward (shown as V in FIG. 1), downward will be opposite upward.

The keyboard engaging member 20 (best seen in FIGS. 2, 3, 5 and 12A) includes a keyboard support surface 22 comprising two spaced apart, generally planar keyboard support surfaces 22*a*, 22*b* extending above a center section 24. The support surface 22 supports a planar keyboard rest 26 (shown in dashed line in FIG. 1) on which the keyboard 12 is disposed. The keyboard engaging member 20 also includes a pair of side pieces 28*a*, 28*b* which extend rearwardly from the center section 24 and are oriented vertically. The respective side pieces 28*a*, 28*b* each include a pair of rearwardly extending fingers 30, 31 that define an engagement between the keyboard engaging member 30 and the linkage assembly 60. The fingers 30, 31 are generally coplanar with the side pieces 28*a*, 28*b*. The finger 30 includes an arcuate slot 32 and the finger 31 includes an aperture or hole 32 disposed vertically above the slot 32. The side pieces 28*a*, 28*b* also each include four small apertures 34 surrounding the slot 30 sized to receive legs 81 of a wedge 82 of the braking assembly 80

Figure 4:
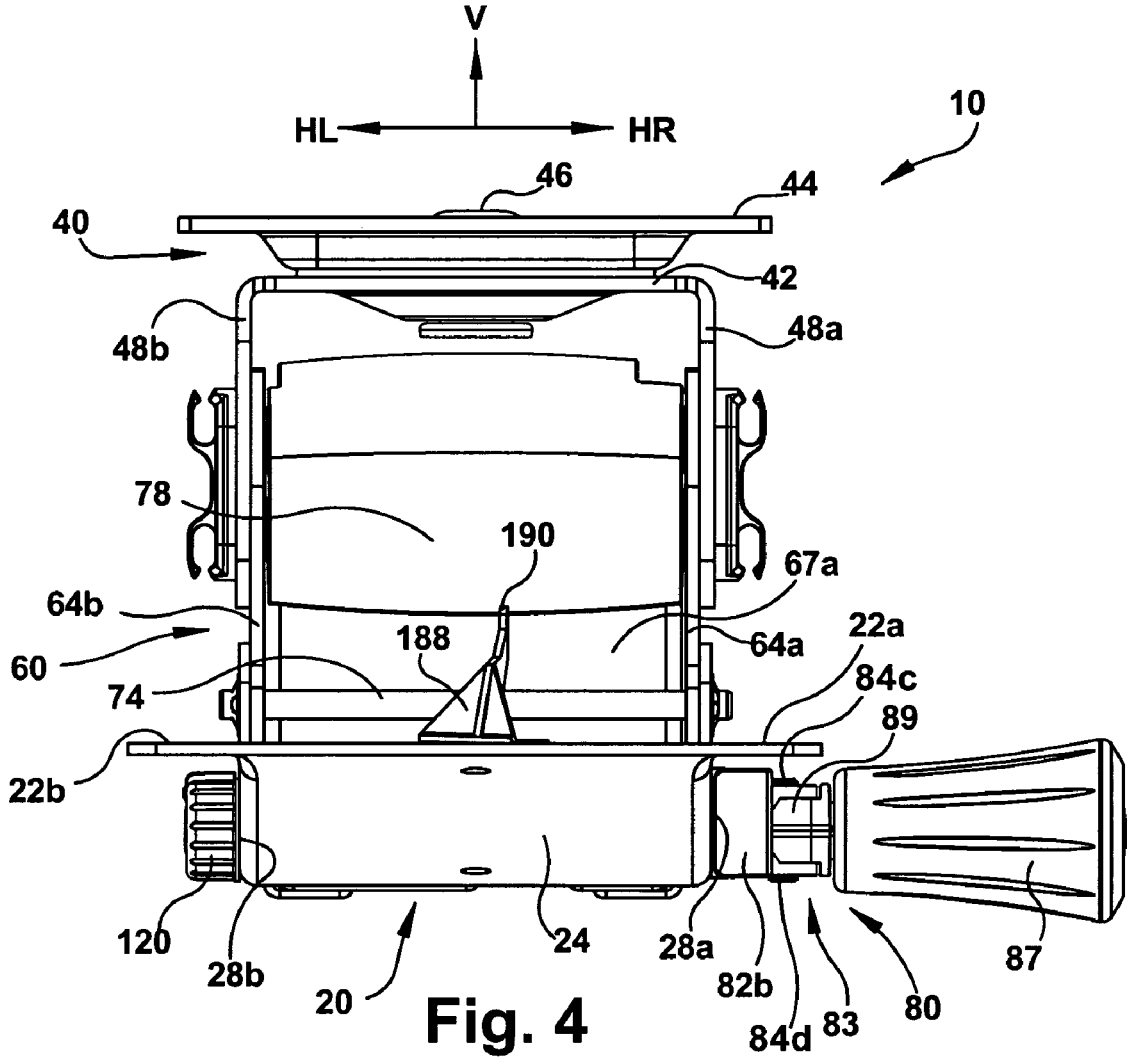
FIG. 4 is a front elevation view of the keyboard support of FIG. 1.

The workstation engaging member 30 (best seen in FIGS. 2, 3 and 4) includes a U-shaped clevis bracket 32 and flange 34 secure the keyboard support 10 to an underside 16 of a desk 14. The flange 34 is affixed to the desk underside 16 with four screws. Obviously, one of skill in the art would recognize that there are other methods of affixing the workstation engaging member 30 to the desk underside 16.

A spin rivet 36 extends through aligned openings in the bracket 32 and an upper planar surface 38 of the bracket 32 to rotatably affix the bracket 32 to the flange 34. This allows the keyboard support 10 to be pivoted about the rivet 36 to either the left or right side of the user, if desired. It should also be noted that instead of the flange 34 being mounted directly to the underside 16 of the desk 14, if desired the flange 34 may be part of a carriage having ball bearing slides which slide within tracks of a housing affixed to the underside 16 of the desk as disclosed in the '467 patent to Timm referenced earlier. Alternately, instead of ball bearing slides, the carriage may utilize polymer slide bearings.

The linkage assembly 60 (best seen in FIGS. 2, 5, 6 and 10) permits the keyboard engaging member 20 to be moved vertically upward and downward with respect to the workstation engaging member 40 and with respect to an orientation or tilt angle A (FIG. 5) of the keyboard 12. The tilt or angle of inclination of the keyboard 12 is positive if the keyboard or keyboard support surfaces 22*a*, 22*b* are tilted toward a user and negative if the keyboard 12 is tilted away from the user. Moving the keyboard engaging member 20 vertically changes a height of the keyboard 12 with respect to the working upper surface 16 of the desk 14.

The linkage assembly 60 includes a lower bracket 62 and a pair of upper supports or arms 64*a*, 64*b* all pivotally supported by the downwardly extending supports 48*a*, 48*b* of the workstation engaging member 40. The supports 48*a*, 48*b* define the engagement between the workstation engaging member 40 and the linkage assembly 60.

At a rearward end, the upper pair of support arms 64*a*, 64*b* include aligned openings 68 that accommodate a bearing in the form of a rod 69 that is received in aligned openings 49 of the downwardly extending supports 48*a*, 48*b*. The upper support arms 64*a*, 64*b* pivot about the rod 69. A spring counterbalance assembly 100 (described below) includes a pair of counterbalance springs 102, 104 (described below) disposed around the rod 69 to assist the user in raising the keyboard engaging member 20. The rod 69 also supports a protective cover 78 that slides along the upper planar cross piece 67*a* of the lower bracket 62. The cover 78 helps to keep dirt and debris from the counterbalance assembly and also provides a pleasing aesthetic appearance.

The lower bracket 62 is rectangular in cross section and defines two lower support arms 66*a*, 66*b* bridged by top and bottom planar cross pieces 67*a*, 67*b*. The lower support arms 66*a*, 66*b* of the lower bracket 62 also define openings 70 that accommodate a bearing in the form of a second rod 74 that is also attached to the downwardly extending supports 48*a*, 48*b*.

At a forward end of the upper pair of support arms 64*a*, 64*b*, the arms include tabs 71 that define arcuate slots 72 and openings 73. A bearing rod or connector 74 extending through the openings 73 of the pair of elongated arms 64*a*, 64*b* and the openings 33 in the fingers 31 of the keyboard engaging member 20 to pivotally connect the keyboard engaging member 20 and the upper support arms 64*a*, 64*b* to allow relatively unrestricted relative rotation between the keyboard engaging member 20 and the workstation engaging member 40. A threaded bearing rod 75 extends through arcuate slots 32 in fingers 30 of the keyboard engaging member 20 and arcuate slots 72 in tabs 71 of the pair of upper elongated arms or supports 64*a*, 64*b*.

The angle between the workstation engaging member 40 and the pair of upper supports 64*a*, 64*b* and the pair of lower supports 66*a*, 66*b* determines the height of the keyboard 12 in relation to the desk 14. The angle between the workstation engaging member 40 and the upper and lower supports 64*a*, 64*b*, 66*a*, 66*b* is, in turn, determined by the position of threaded rod 75 along the arcuate slots 72. The workstation engaging member 40 extends away from the desk 14 in a direction generally parallel to the desk top or work surface 16. This corresponds to a maximum keyboard height adjustment for the support 10.

Braking Assembly 80

The braking system or assembly 80 provides for a locked condition and an unlocked condition. In the locked condition, the linkage assembly 60 is fixed such that there is no relative movement of the keyboard engaging member 20 with respect to the workstation engaging member 40. In the unlocked condition, the linkage assembly moves or pivots so as to allow relative movement of the keyboard engaging member 20 with respect to the workstation engaging member 40.

As can best be seen in FIGS. 6-11, one exemplary embodiment of the braking system 80 of the present invention includes the wedge 82 and a roller assembly 83 including a pair of rollers 84*a*, 84*b*. In one preferred embodiment, the rollers 84*a*, 84*b* are mounted on a pair of axles 84*c*, 84*d* extending from opposite ends of a hub or body 89 of the roller assembly 83 (only a top one of the axles 84*c* cab be seen in FIG. 2). The rollers 84*a*, 84*b* are solid metal rollers which are in direct contract with the axles 84*c*, 84*d* and a bearing surface of the wedge 82. An inner bore of the respective rollers 84*a*, 84*b* functions as an integral plane bearing. The wedge 82 is affixed to an outer surface of the finger 30 of the keyboard engaging member right hand side piece 28*a*. Specifically, the wedge 82 includes a pair of legs which fit into two small apertures 34 in the side piece finger 30.

The roller assembly 83 is slidably mounted on the threaded rod 75 and is biased inwardly to contact the wedge 82 by a bias spring 85 disposed between a flat bearing surface 86 of a tilt adjustment knob 87 and a stepped portion 88 of the hub 89 of the roller assembly 83. The bias spring 85 serves to hold the roller assembly 83 against the wedge 82 when the braking system 80 is in a disengaged or unlocked position. A hex head 76 of the threaded rod 75 bears against the finger 30 of the left hand side piece 28*b*. The tilt adjustment knob 87 includes internal threads 90 which are threaded onto a threaded distal end 77 of the rod 75. The wedge 82 includes an arcuate opening 91 which is aligned with the arcuate slot 32 in the right side piece finger 30. The wedge 82 increases in thickness moving from back 82*a* to front 82*b*. The rollers 84*a*, 84*b* are constrained to roll along an outer surface 92 of the wedge 82 and, more specifically, along a path of travel on the outer surface 92 adjacent the arcuate opening 91 of the wedge 82 because the threaded rod 75 extends through the arcuate opening 91.

A position of the rollers 84*a*, 84*b* on the outer surface 92 of the wedge 82 determines the force applied by the flat bearing surface 86 of the tilt knob 87 to the roller assembly hub 89 (FIG. 9) and thereby the force applied by the rollers 84*a*, 84*b* against the wedge 82. The force applied by the rollers 84*a*, 84*b* against the wedge 82 determines, in turn, the frictional engagement force between the upper support arms 64*a*, 64*b*, the lower support arms 66*a*, 66*b* and the side pieces 28*a*, 28*b* of the keyboard engaging member 20. More specifically, the frictional engagement between an outer surface of a forward end portion (including the tabs 71) of the upper support arms 64*a*, 64*b* and an inner surface of the pair of fingers 30, 32 extending from the side pieces 28*a*, 28*b* of the keyboard engaging member 20 and between an inner surface of the forward end portion of the upper support arms 64*a*, 64*b* and an outer surface of a forward end portion the lower support arms 66*a*, 66*b* of the bracket 62.

Figure 8:
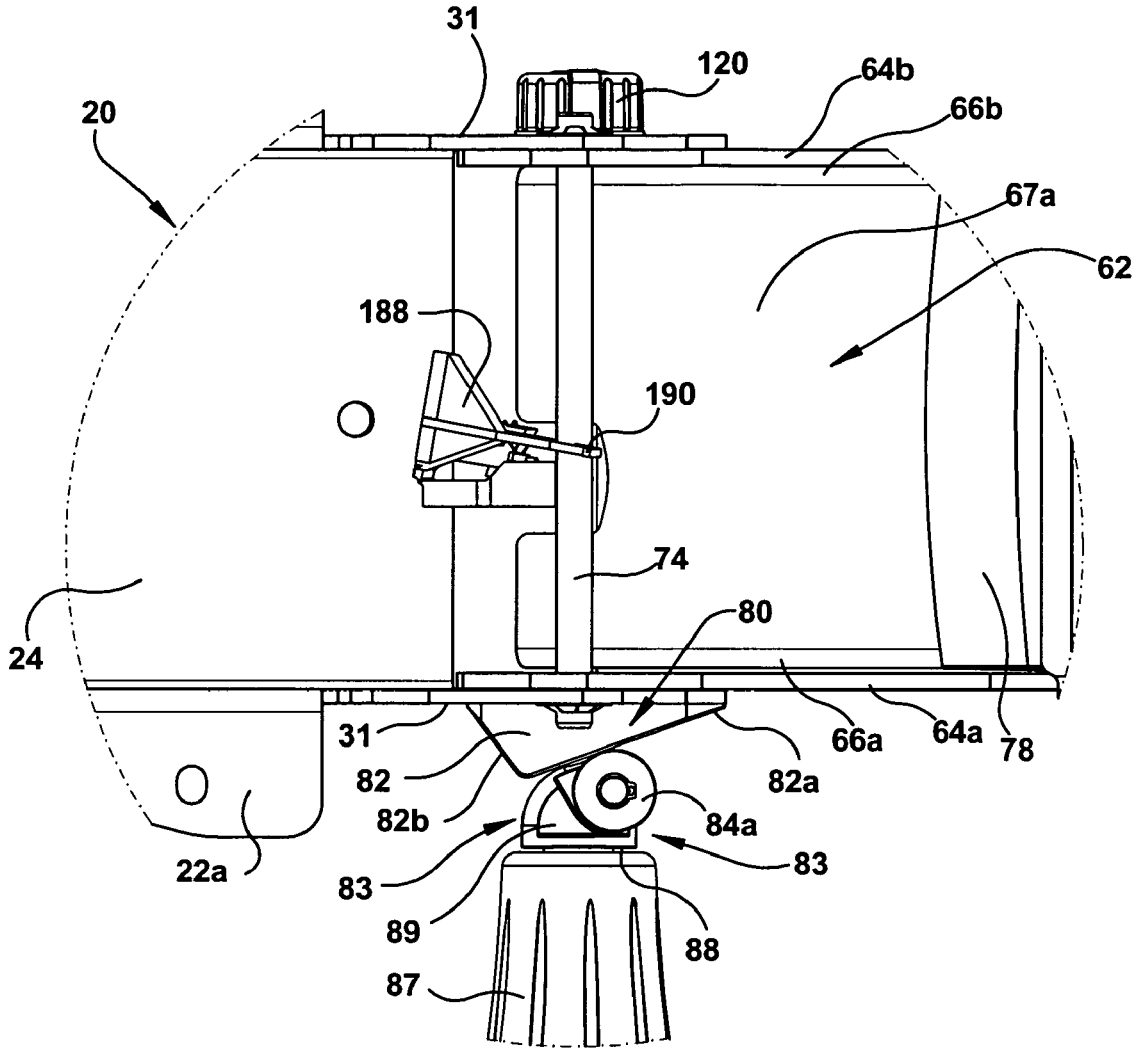
FIG. 8 is a top plan view of the braking assembly in the locked or braking position.
Figure 9:
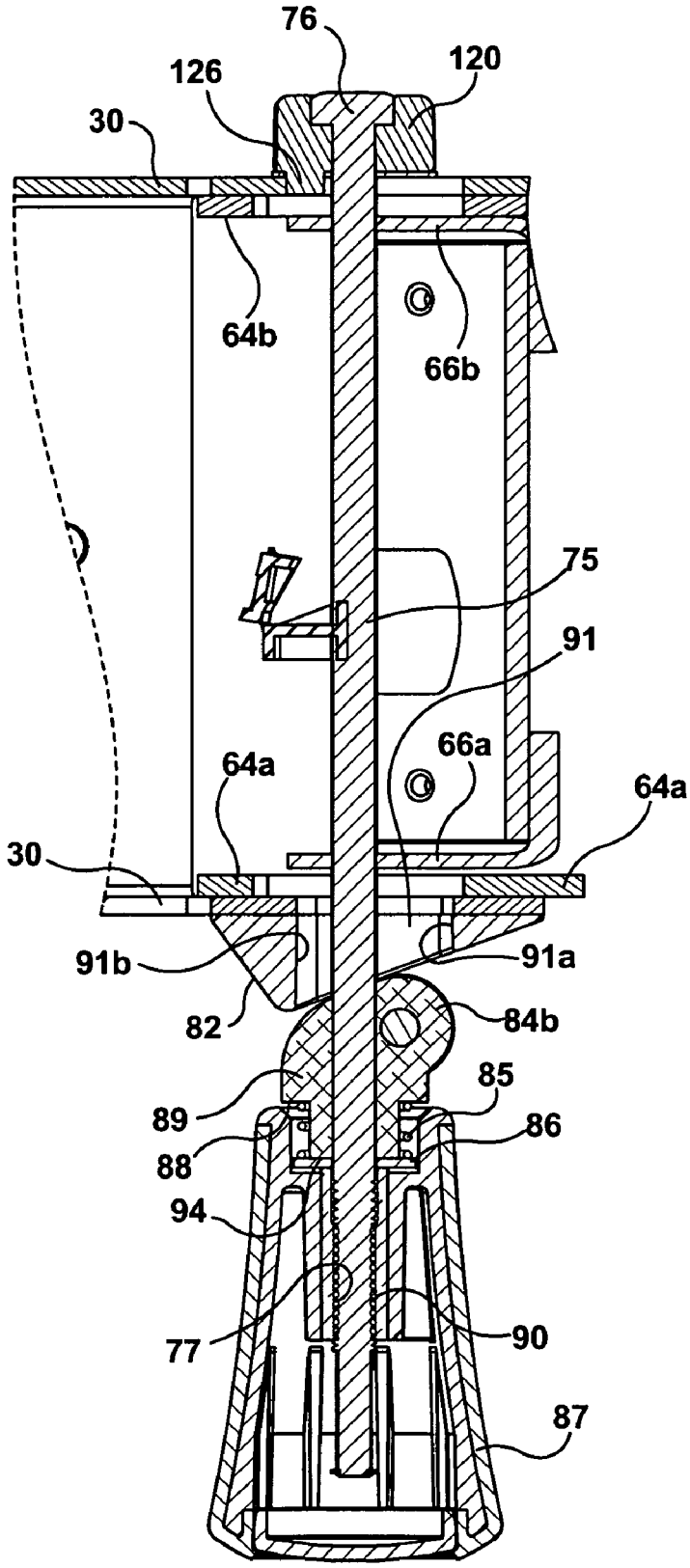
FIG. 9 is a sectional view of the braking assembly in the braking position.

The roller position with respect to the wedge 82 can best be seen in the views shown in FIGS. 8-11. In FIGS. 8 and 9, the braking position of the braking assembly 80 is shown. As can be seen the threaded rod 75 is near a forward end 91*b* of the wedge arcuate opening 91. In this braking position, the wedge 82 is thicker, forcing the roller assembly 83 outwardly to the right along the threaded rod 75 and thereby compressing the spring 85 to the point that an end 94 of the roller assembly hub 89 contacts the bearing surface 86 of the tilt assembly knob 87.

In this braking position, the frictional engagement force between the outer surface of forward end portion of the upper elongated support arms 64*a*, 64*b* and the inner surface of the pair of fingers 30, 32 extending from the side pieces 28*a*, 28*b* of the keyboard engaging member 20 and between the inner surface of the forward end portion of the upper support arms 64*a*, 64*b* and the outer surface of a forward end portion the two lower support arms 66*a*, 66*b* of the bracket 62 is sufficient to prevent the keyboard engaging member 20 from pivoting with respect to the bearing rod 74. There is also a braking force generated by the contact of the rollers 84*a*, 84*b* to the contact surface 93 of the wedge 82 because a contact angle between the rollers 84*a*, 84*b* and the wedge 82 functions to oppose relative movement of the rollers 84*a*, 84*b* along the wedge 82. Since the upper support arms 64*a*, 64*b* and the lower supports arms 66*a*, 66*b* cannot move with respect to each other, the keyboard engaging member 20 is locked in position with respect to the workstation engaging member 40, thus, the braking assembly 80 is in the locked condition.

Figure 11:
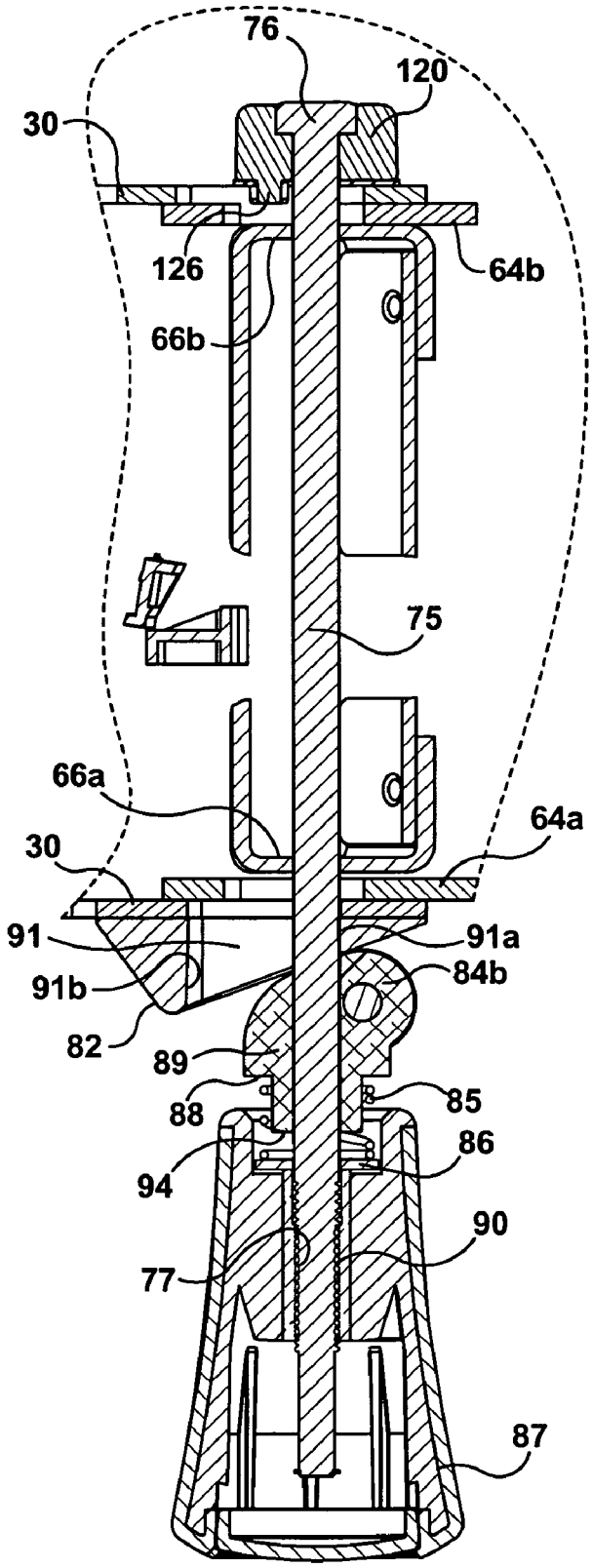
FIG. 11 is a sectional view of the braking assembly in the non-braking position.

In FIG. 11, a nonbraking position of the braking assembly 80 is shown. As can be seen the threaded rod 75 is at or near the rearward end 91*a* of the wedge arcuate opening 91. In this nonbraking position, the thickness of the portion of the wedge 82 contacted by the rollers 84*a*, 84*b* is reduced compared to the braking position. The roller assembly hub 89 is not moved outwardly to the right as much as in the braking position and the biasing spring 85, therefore, is less compressed. The frictional engagement force is reduced between the upper and lower support arms 64*a*, 64*b*, 66*a*, 66*b*. In the nonbraking position, the frictional engagement force between the upper support arms 64*a*, 64*b*, the lower support arms 66*a*, 66*b*, and the side pieces 28*a*, 28*b* of the keyboard engaging member 20 is reduced such that the keyboard engaging member 20 pivots with respect to the bearing rod 74. Since the upper support arms 64*a*, 64*b* and the lower support arms 66*a*, 66*b* can move with respect to each other, the keyboard engaging member 20 is movable with respect to the workstation engaging member 40.

Figure 10:
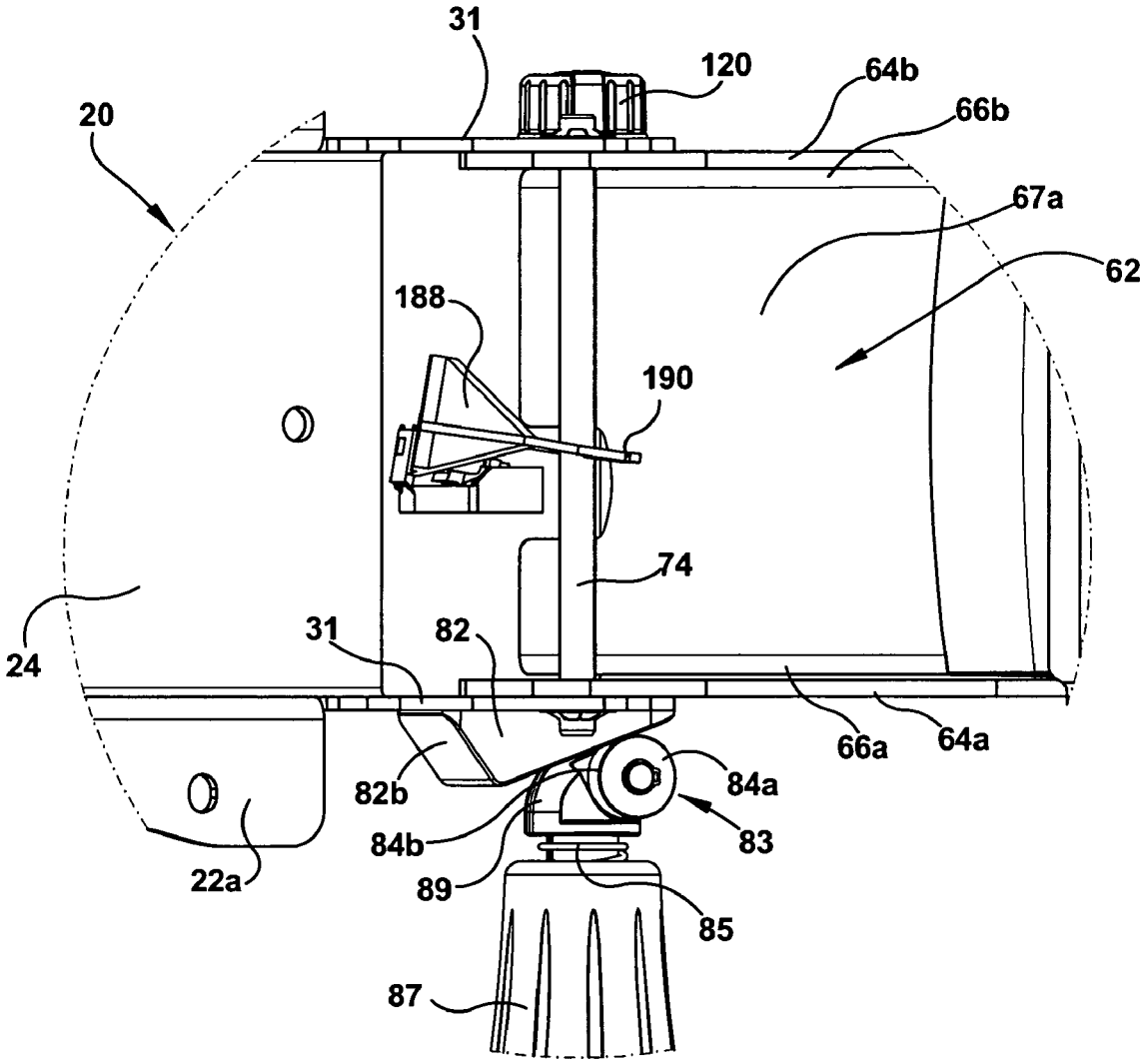
FIG. 10 is a top plan view of the braking assembly in the unlocked or non-braking position.

It should be noted, however, that an any position of the rollers 84*a*, 84*b* along the wedge outer surface 92, including the position shown in FIGS. 10 and 11, if the tilt adjustment knob 87 is turned sufficiently in the clockwise direction (as viewed in FIG. 5), that is, the tilt knob 87 being threaded further onto the rod 75, it will cause the biasing spring 85 to compress, and ultimately enough force will be applied by the flat bearing surface 86 of the tilt knob 87 to the roller assembly hub 89 to cause the braking system 80 to be in a braking position, that is, the keyboard engaging member 20 will be locked with respect to the workstation engaging member 40, thus, the braking assembly 80 is in the locked condition.

Figure 5:
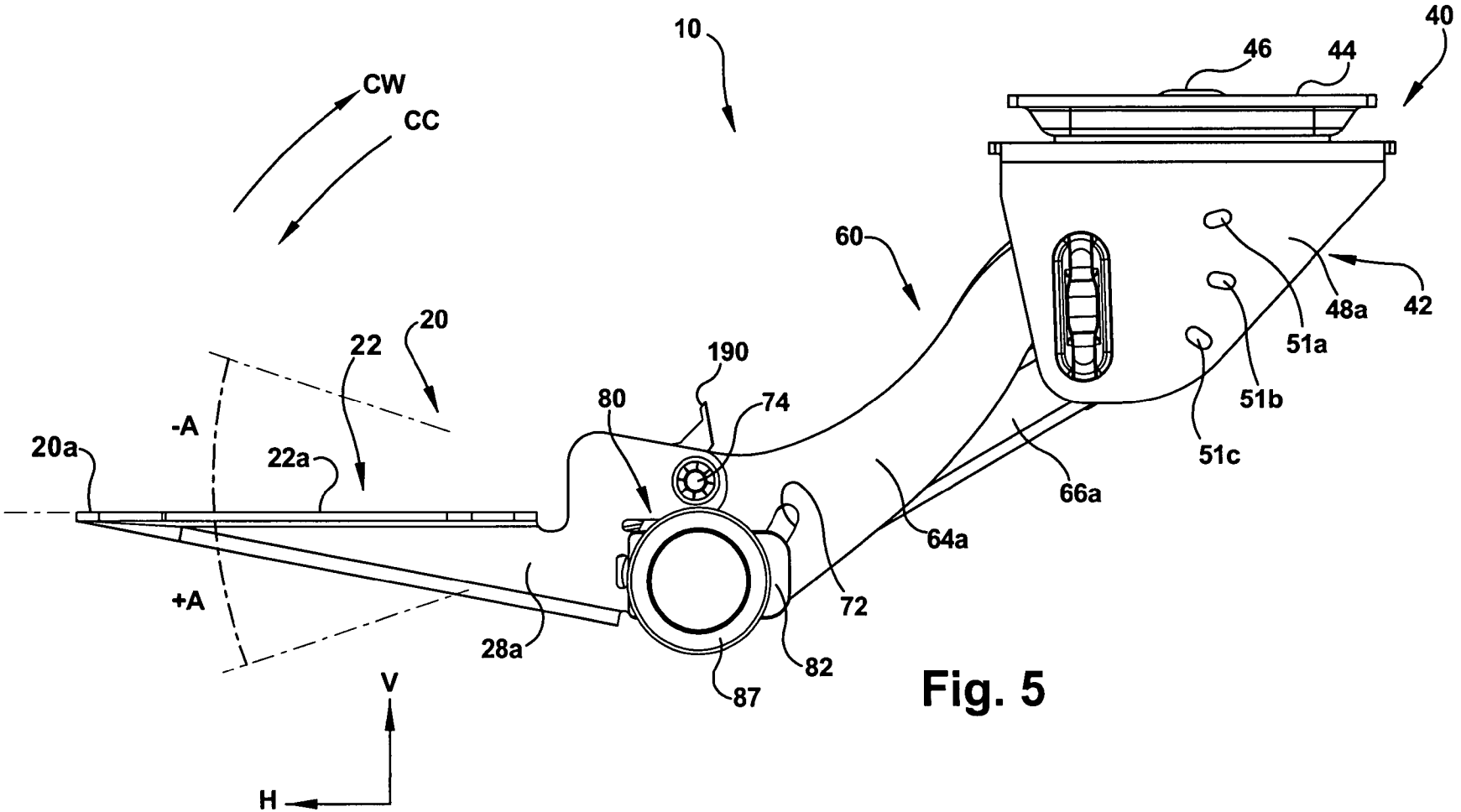
FIG. 5 is a side elevation view of the keyboard support of FIG. 1.
Figure 6:
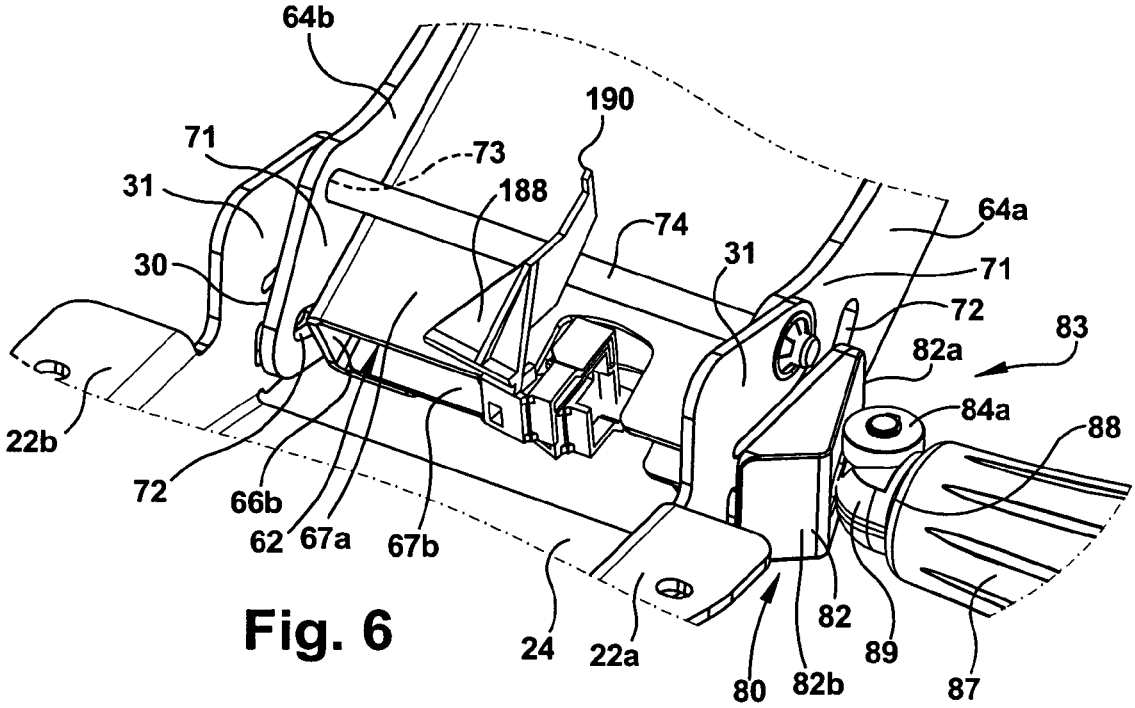
FIG. 6 is a perspective view of a braking assembly of the keyboard support of FIG. 1.
Figure 7:
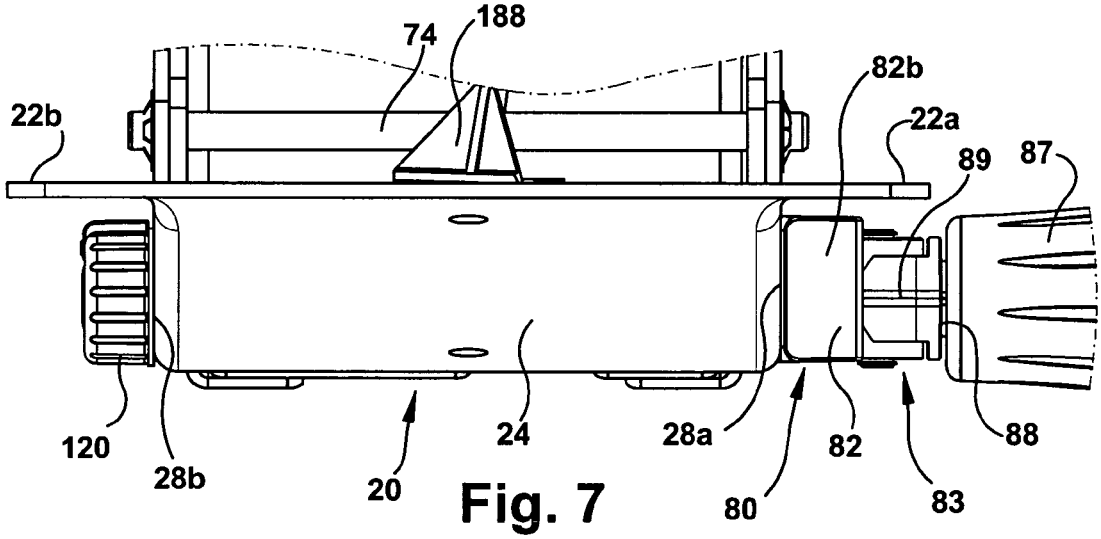
FIG. 7 is a front elevation view of the braking assembly of FIG. 6.

A downward pressure on the keyboard engaging member 20 and specifically the front portion 20*a*, tends to rotate the keyboard support surfaces 22*a*, 22*b* in a counterclockwise direction (shown as CC in FIG. 5). This moves the wedge 82 rearwardly with respect to the threaded rod 75 and the roller assembly 83. As the wedge 82 moves rearwardly, the rollers 84*a*, 84*b* turn and a thickness of the portion of the wedge directly under the rollers 84*a*, 84*b* increases. This urges the roller assembly 83 outwardly along the threaded rod 75 increasing the compression of the spring 85 and the frictional engagement force between the upper and lower supports 64*a*, 64*b*, 66*a*, 66*b* and the sidepieces 28*a*, 28*b* of the keyboard engaging member 20 and, ultimately, moves the braking assembly 80 to the braking position. This self locking feature of the braking system 80 prevents unintended downward motion of the keyboard engaging member 20.

To adjust the height of the keyboard support surfaces 22*a*, 22*b*, the user rotates the keyboard engaging member 20 about the rod 74 in an upward direction (clockwise—shown as CW in FIG. 5) by lifting upwardly on the front portion 20*a* of the keyboard engaging member 20 to a tilt angle about −23°. Rotating the keyboard support surfaces 22*a*, 22*b* in a clockwise direction moves the wedge 82 forwardly with respect to the threaded rod 75 and the roller assembly 83. As the wedge 82 moves forwardly, the rollers 84*a*, 84*b* turn on the wedge and the thickness of the portion of the wedge directly under the rollers 84*a*, 84*b* decreases. The bias spring 85 urges the roller assembly 83 inwardly along the threaded rod 75. When the flat bearing surface 86 of the tilt knob 87 disengages or no longer contacts the roller assembly hub 89, the braking assembly 80 is in the unlocked condition and the frictional engagement force between the upper and lower support arms 64*a*, 64*b*, 66*a*, 66*b* and the sidepieces 28*a*, 28*b* of the keyboard engaging member 20 is sufficiently decreased to permit relative movement of the keyboard engaging member 20 with respect to the workstation engaging member 40 and thereby allow the height of the keyboard rest 26 to be adjusted.

Even during the unlocking procedure, the bias spring 85 maintains some pressure on the roller assembly 83 so that the rollers 84*a*, 84*b* do not slip off or away from their path of travel along the periphery 93 of the wedge outer surface 92 adjacent the arcuate opening 91. Further, since the roller assembly hub 89 is rotatable coaxially with respect to the threaded rod 75, the rollers 84*a*, 84*b* exhibit a swiveling castor effect to insure that the rollers are aligned with respect to the wedge opening 91. When the user releases the keyboard engaging member 20, the rollers 84*a*, 84*b* roll forwardly along the wedge 82 providing increased frictional engagement between the upper and lower support arms 64*a*, 64*b*, 66*a*, 66*b* and the sidepieces 28*a*, 28*b* of the keyboard engaging member 20 to lock the height of the keyboard engaging member 20. Movement of the rollers 84*a*, 84*b* with respect to the surface of the wedge 82 is approximately 0.9 inches laterally along the bearing face 93 of the wedge 82 and less than 0.1 inches axially along the rod 75 in moving between the locking and non-locking positions which is a result of a clearance space between the flat bearing surface 86 of the tilt knob 87 to the roller assembly hub 89 collapsing when going from a unlocked condition to a locked condition.

Tilt Adjustment of Keyboard Engaging Member 20

The tilt adjusting knob 87 (best seen in FIGS. 8, 9, 10 and 11), in conjunction with the braking assembly 80 allows the user to control the tilt angle of the keyboard engaging member 20. The knob 87 is threaded onto the threaded rod 75 thereby trapping the bias spring 85 between the knob 87 and the stepped surface 88 of the roller assembly hub 89. When the braking assembly 80 is in an unlocked condition, by rotating the knob 87 clockwise or counterclockwise, the user can change an angle of tilt from a present position of the keyboard support surface 22*a*, 22*b* with respect to the rod 74. Looking at FIG. 5, from a given position, if the keyboard support surface 22*a* is rotated about the rod 74 in a clockwise direction CW, the movement is defined to be a negative tilt angle (shown as −A in FIG. 5) away from the user. If the keyboard support surface 22*a* is rotated about the rod 74 in a counterclockwise direction, the movement is defined to be a positive tilt angle (shown as +A in FIG. 5) toward the user.

As the knob 87 is rotated clockwise as viewed from the right hand side (FIG. 5), the knob is threaded further onto the rod 75, thereby causing the rollers 84*a*, 84*b* to exert greater force on the wedge 84. Increasing the force on the wedge 84 causes the wedge to move forwardly (toward the user) thereby decreasing a thickness of the wedge under the rollers 84*a*, 84*b* and accordingly decreasing the force applied by the rollers to the wedge. The wedge 84 is attached to the keyboard engaging member 20 and the keyboard engaging member pivots about the rod 74. Thus, as the wedge 84 moves forwardly (toward the user), the keyboard engaging member 20 pivots upwardly (or clockwise) about the rod 74 resulting in a negative angular change in keyboard orientation (see FIG. 5).

By the same token, as the knob 87 is rotated counterclockwise as viewed from the right hand side (FIG. 5), the knob is unthreaded from the rod 75, thereby causing the rollers 84*a*, 84*b* to exert less force on the wedge 84. Because of the weight of the keyboard engaging member 20 and the keyboard 12 supported thereon, the wedge 84 is biased to move rearwardly (away from the user). Decreasing the force on the wedge 84 causes the wedge to move rearwardly thereby increasing a thickness of the wedge under the rollers 84*a*, 84*b* and thus increasing the force applied by the rollers to the wedge until an equilibrium is achieved. Thus, as the wedge 84 moves rearwardly, the keyboard engaging member 20 pivots downwardly (or counterclockwise) about the rod 74 resulting in a positive angular change in keyboard orientation (see FIG. 5). In some instances, because of the rollers 84*a*, 84*b* are not zero friction rollers, the user may need to press down slightly on a front edge portion 20*a* of the keyboard engaging member 20 to facilitate a positive tilt angle change.

When the braking assembly 80 is in the locked condition, rotation of the tilt knob 87 in the counterclockwise direction (loosening the knob) will result in a positive tilt angle change in keyboard orientation. However, if the braking assembly 80 is in the locked condition, rotation of the tilt knob 87 in the clockwise direction (tightening the knob) will increase the frictional engagement forces of the linkage assembly 60. This will prevent a negative tilt angle change. In order to effect a negative tilt angle change in keyboard orientation, the front of the keyboard engaging member 20 would have to be pivoted upwardly, at least slightly, to somewhat loosen the linkage assembly 60 and thereby permit negative tilt angle change upon clockwise rotation of the knob 87.

It should be noted that the braking assembly 80 includes relative degrees of locking that are intermediate the locked condition and the unlocked condition. Stated another way, the frictional engagement forces of the linkage assembly 60 vary depending on the magnitude of force applied by the flat bearing surface 86 of the tilt knob 87 to the end 94 of the roller assembly hub 89.

Spring Counterbalance Assembly 100

One exemplary embodiment of a spring counterbalance assembly 100 (best seen in FIGS. 15, 16A, 16B, and 16C) includes the pair of counterbalance springs 102, 104 disposed around the rod 69 to assist the user in raising the keyboard support 10. Advantageously, the spring counterbalance assembly 100 provides for a variable magnitude of spring torsion which can be changed by the user depending on the magnitude of counterbalance force desired by the user and the weight of the keyboard 12 being supported by the keyboard engaging member 20. The left spring 102 provides for a constant torsion force, while the right spring 104 can be engaged with the clevis bracket 42 in a selected one of three different positions to vary the torsion force between low, medium and high torsion force.

The pair of upper support arms 64*a*, 64*b* is bridged by a rod 106. One end 102*a* of the left spring 102 is hooked under the rod 106, while the other end 102*b* of the left spring 102 bears against a bottom surface 50 of the unshaped clevis bracket 42. The left spring 102 thereby provides for a torsion which tends to raise or upwardly pivot the elongated arms 64*a*, 64*b* about the rod 69 and thereby raise the keyboard engaging member 20.

Figure 16A:
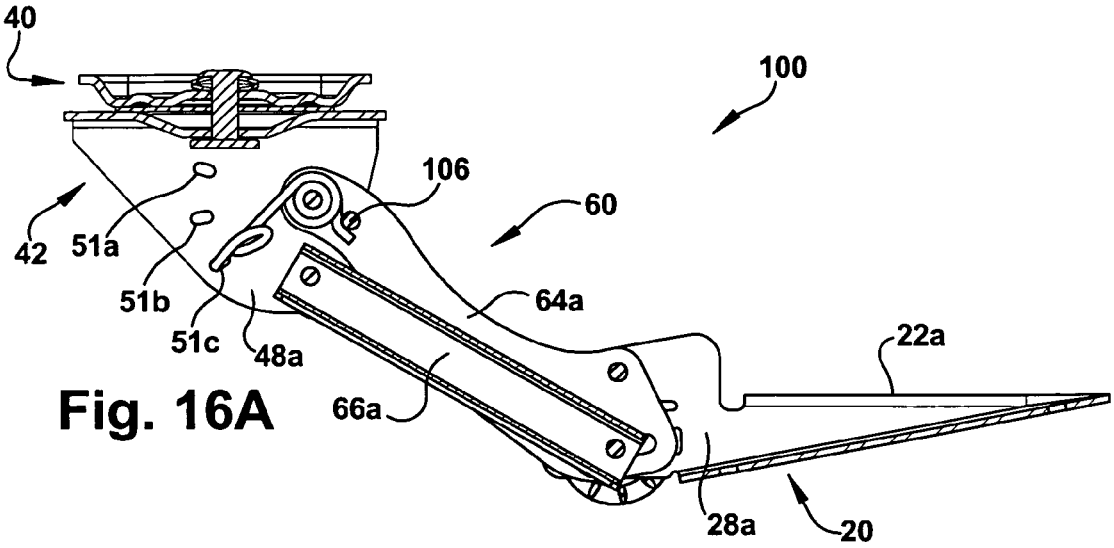
FIG. 16A is a section view of the keyboard support depicting a right side counterbalance torsion spring in a maximum torsion position.

One end 104*a* of the right spring 104 is also hooked under the rod 106, while the other end 104*b* defines a loop 104*c* with a distal end 104*d* insertable into a selected one of three positions corresponding to the three slotted openings 51*a*, 51*b*, 51*c* in the right side downward support 48*a*. As seen in FIG. 16C, if the distal end 104*d* of the right spring 104 is inserted into the vertically highest slotted opening 51*a*, the spring torsion applied by the right spring 104 to the rod 106 is the lowest of the three positions because the spring is more unwound than in any of the other two positions. Thus, the upward counterbalancing force applied to the upper support arms 64*a*, 64*b* and the keyboard engaging member 20 is the lowest of the three positions.

Figure 16B:
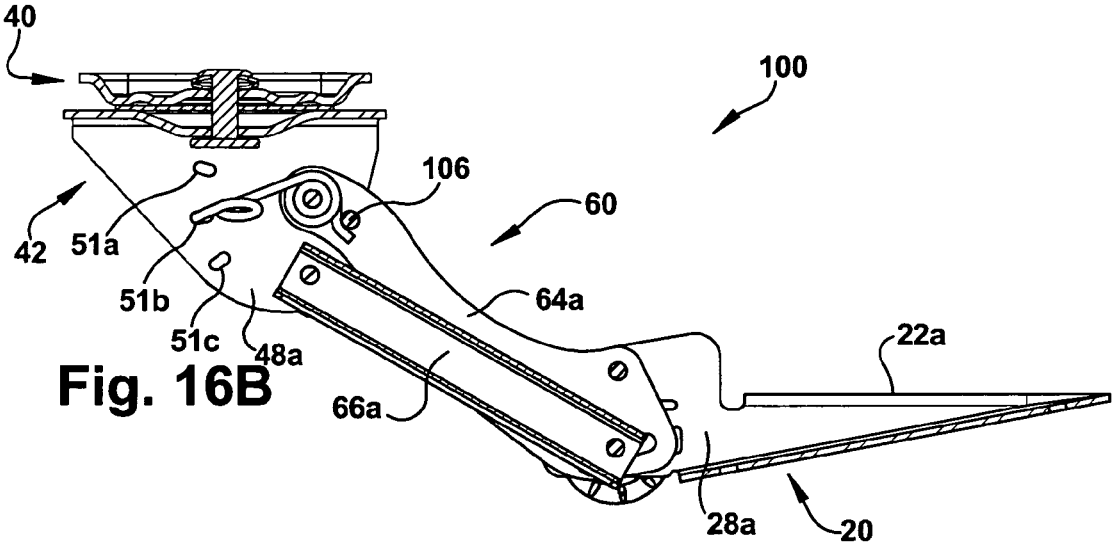
FIG. 16B is a section view of the keyboard support depicting the right side counterbalance torsion spring in an intermediate torsion position.
Figure 16C:
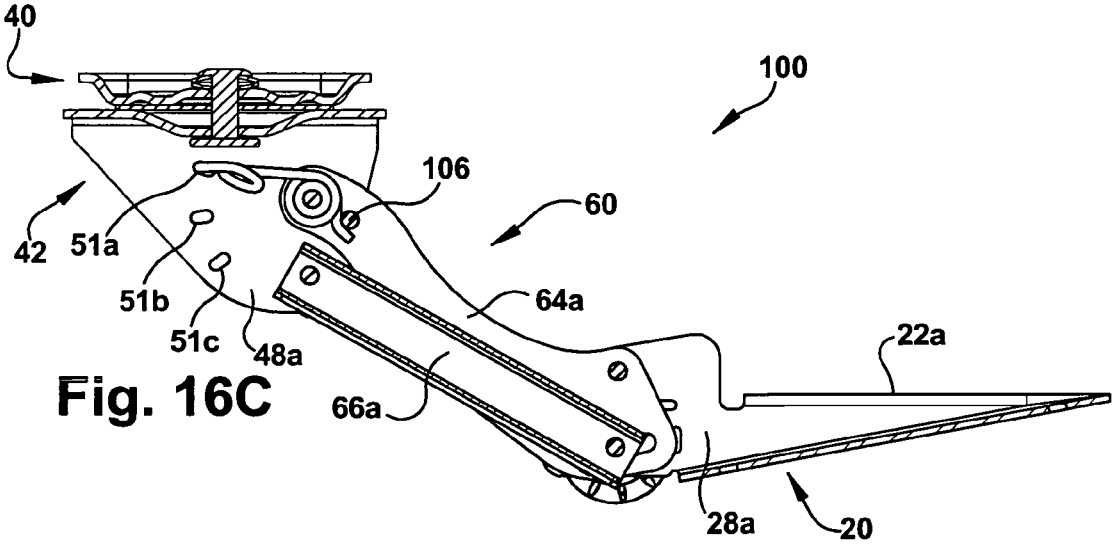
FIG. 16C is a section view of the keyboard support depicting the right side counterbalance torsion spring in a minimum torsion position.
Figure 17:
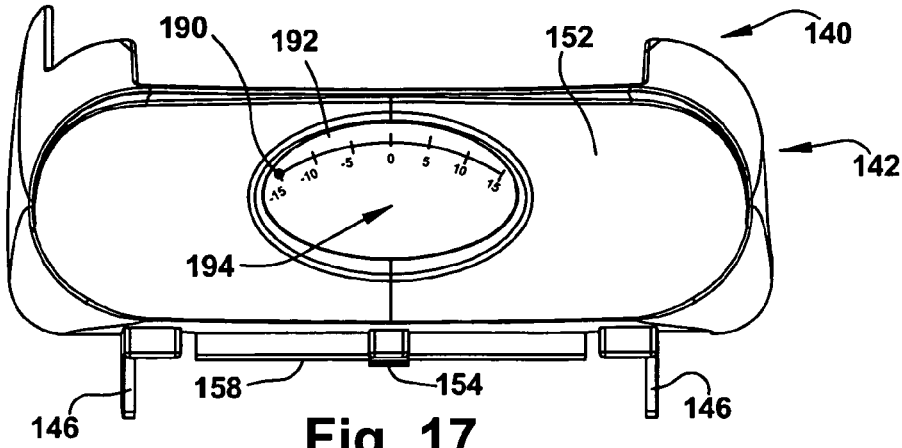
FIG. 17 is a top plan view of a tilt indicator assembly of the keyboard support of FIG. 1.
Figure 18:
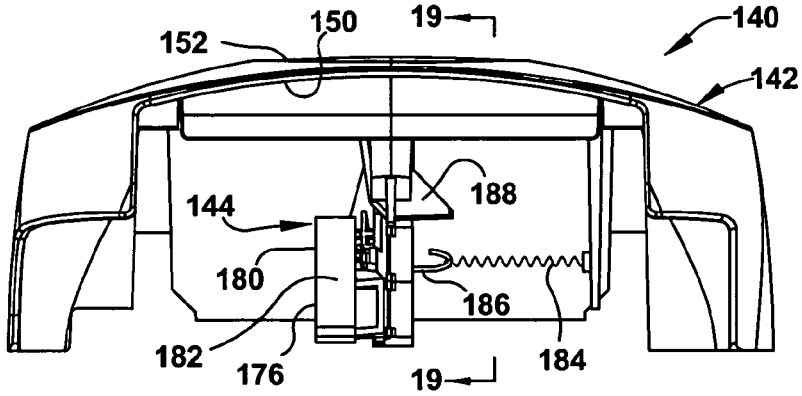
FIG. 18 is bottom plan view of the tilt indicator assembly.
Figure 19:
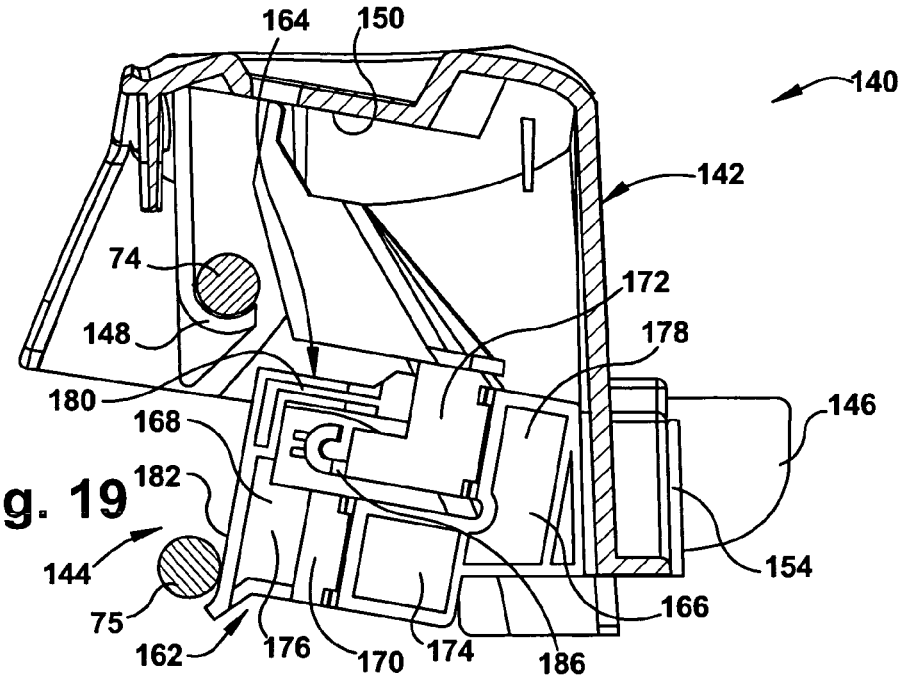
FIG. 19 is a section view of the tilt indicator assembly as seen from a plane indicated by the cut line 19-19 in FIG. 18.
Figure 20A:
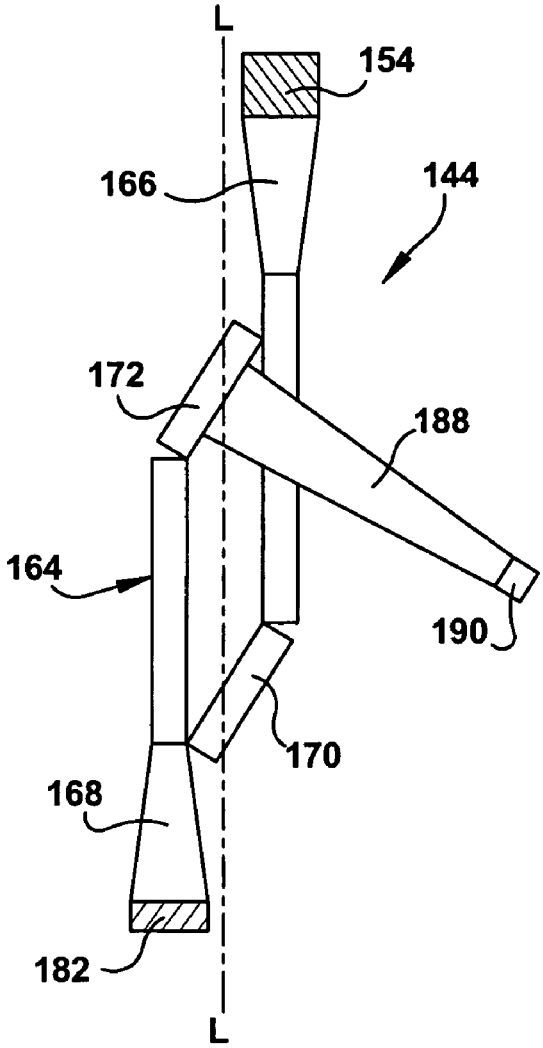
FIG. 20A is a schematic depiction of a four bar parallelogram linkage of the tilt indicator assembly when a keyboard engaging member is in a negative tilt position.
Figure 20B:
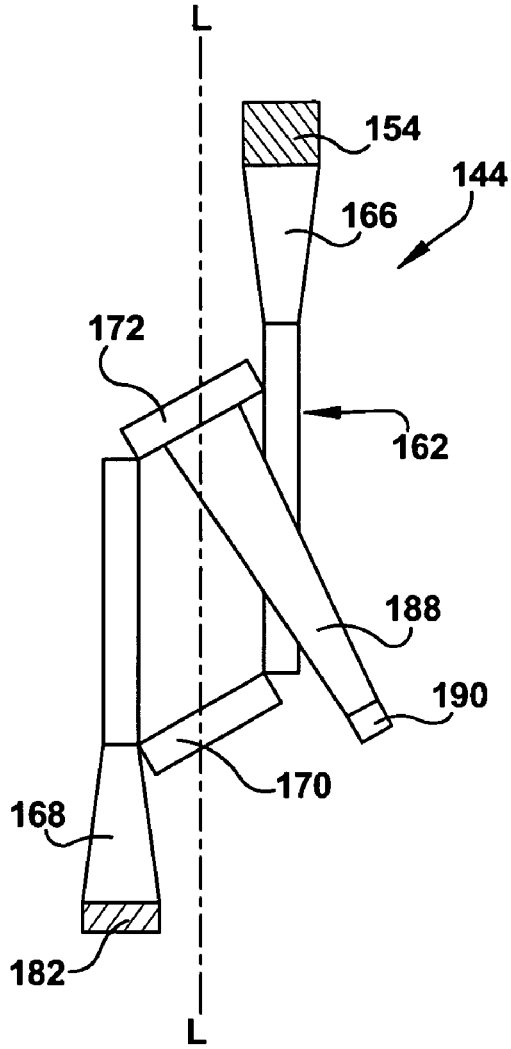
FIG. 20B is a schematic depiction of the four bar parallelogram linkage of the tilt indicator assembly when a keyboard engaging member is in a positive tilt position.

As seen in FIG. 16B, if the distal end 104*d* of the right spring 104 is inserted into the middle slotted opening 51*b*, the spring is more wound up (compared to opening 51*a*) and the spring torsion applied by the right spring 104 to the rod 106 is greater. This provides an intermediate magnitude of counterbalancing force to the upper support arms 64*a,* 64*b* and the keyboard engaging member 20 compared to the other two positions.

Finally, as seen in FIG. 16A, if the distal end 104*d* of the right spring 104 is inserted into the lowest slotted opening 51*c,* the spring is wound even more tightly than when the distal end is in opening 51*b*. This increases the spring torsion applied by the right spring 104 to the rod 106 to a maximum level and, therefore, the counterbalancing force applied to the upper support arms 64*a,* 64*b* and the keyboard engaging member 20 is a maximum level of the three positions.

Tilt Lockout Member 120

Depending upon the size and shape of specific keyboard 12 selected by the user and the seating arrangement used by the user, under certain conditions it may be ergonomically advantageous to prevent too great a positive tilt of the keyboard support surface 22. Additionally, too great a positive tilt may result in the keyboard accidentally sliding off of the keyboard rest 26. Accordingly, a tilt lockout member 120 is provided. As can best be seen in FIGS. 12A, 12B, 13A, 13B, 14A, and 14B, the tilt lockout member 120 fits over the hex-headed end 76 of the threaded rod 75 and slides on the rod. It should be noted that other shapes besides hexagonal may be used for the rod end 76 provided the shape provides a bearing surface for the tilt lockout member 120.

The lockout member 120 is adapted to be pivoted between a lockout position and a non-lockout position. An opening 122 of the tilt lockout member 120 receives the hex-headed end 76 of the rod 75 and a shoulder 124 of the tilt lockout member prevents the tilt lockout member from falling off the hex-headed end 76. The lockout member 120 includes an inwardly extending arm 126 which is adapted to extend into the arcuate slot 32 of the left side finger 31.

Figure 13A:
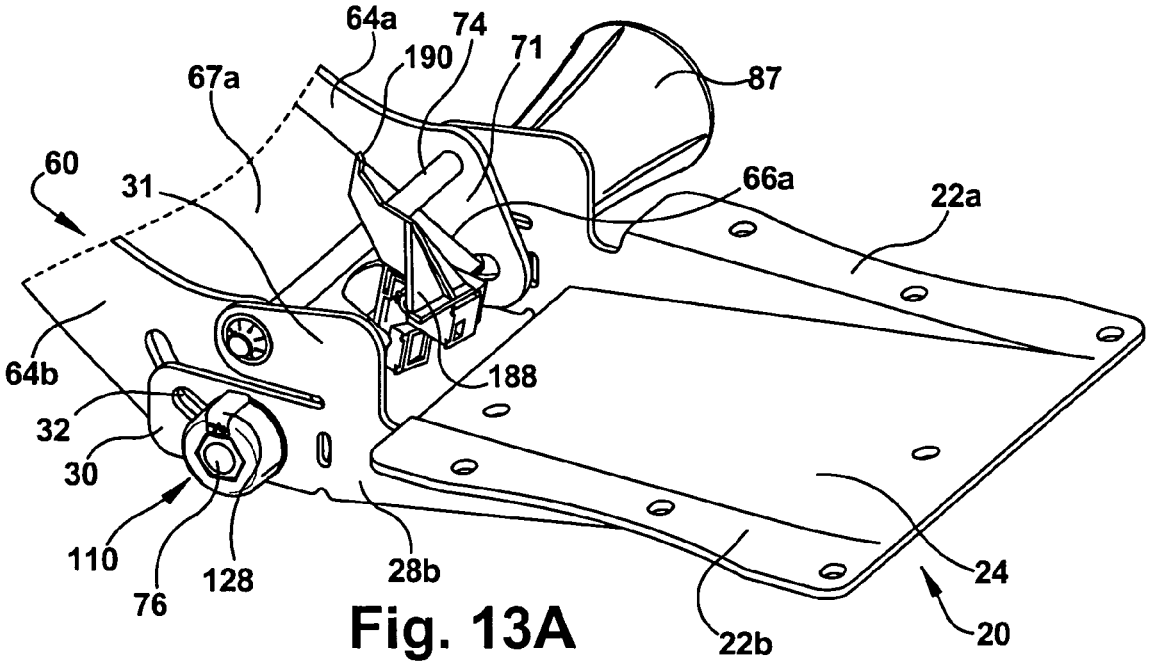
FIG. 13A is a perspective view of the tilt lockout member in a position restricting positive tilt of the keyboard engaging member.
Figure 13B:
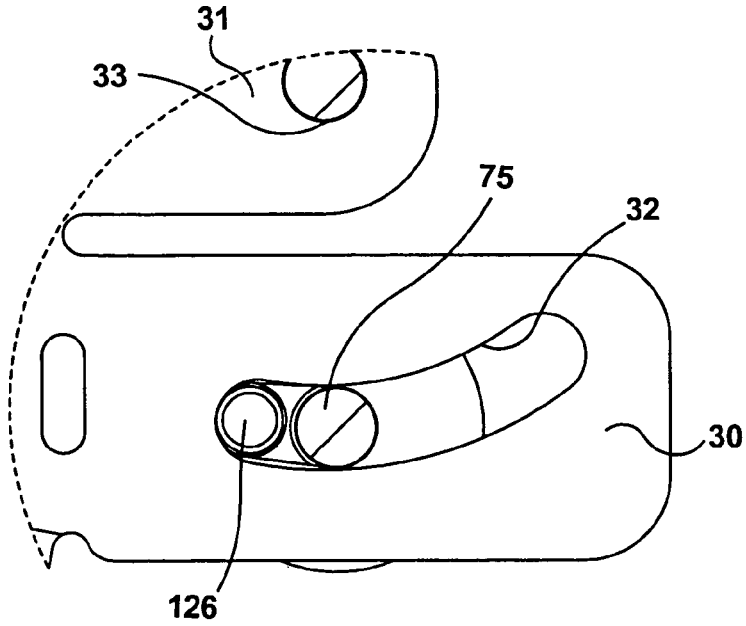
FIG. 13B is a side elevation view of an arm of the tilt lockout member in a position restricting positive tilt of the keyboard engaging member.
Figure 14A:
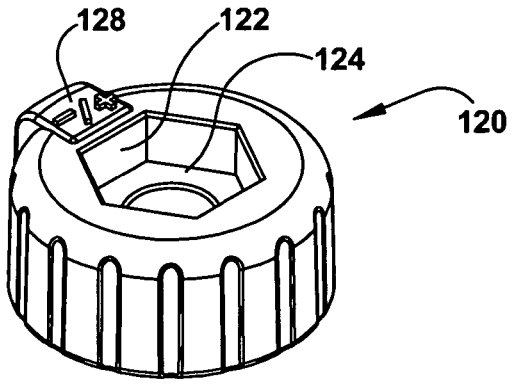
FIG. 14A is a top perspective view of the tilt lockout member.
Figure 14B:
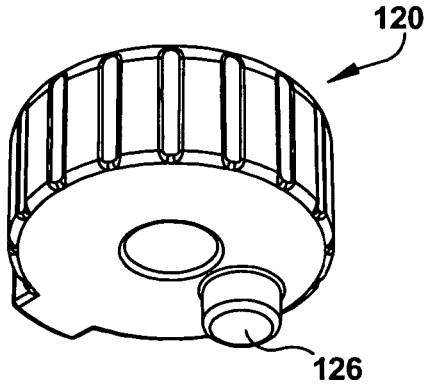
FIG. 14B is a bottom perspective view of the tilt lockout member.
Figure 15:
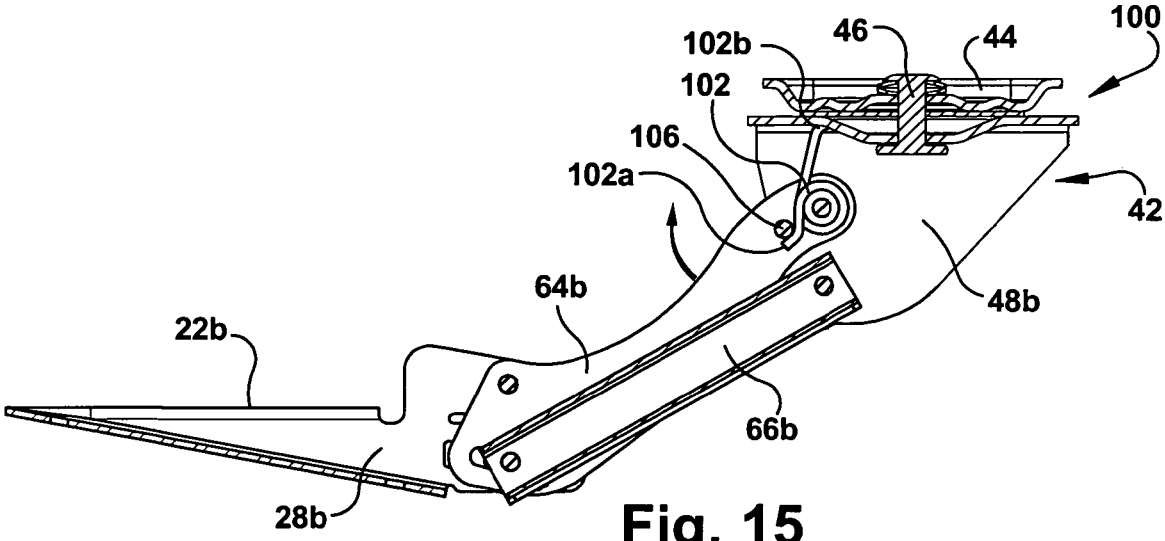
FIG. 15 is a section view of the keyboard support depicting a left side counterbalance torsion spring.

When tilt lockout member 120 is positioned with respect to the rod 75 such that the arm 126 extends into the arcuate slot 32 forwardly (toward the user) of the rod, as seen in FIGS. 13A and 13B, the tilt lockout member 120 is in the tilt lockout position and the usable angle of tilt of the keyboard engaging member 20 is limited to 0° to −15° using the adjustment knob 87. That is, positive tilt is locked out. The reason that the positive tilt angle is limited to 0° is that, as noted above, the arm 126 extends into the arcuate slot 32 forwardly of rod 75. Thus, the keyboard support member 40 cannot be pivoted downwardly beyond a tilt angle of 0° because at 0°, a forward edge of the slot 32, that is, a left side of the slot 32 as viewed in FIG. 13B, is in contact with the arm 126 and further positive tilt is precluded. Advantageously, if unlocking of the braking assembly 80 is desired, this can still be accomplished with the tilt lockout member 120 in the tilt lockout position or the non lockout position simply by lifting a front edge of the keyboard engaging member 20 to a tilt angle of −23° to disengage the brake.

Figure 12A:
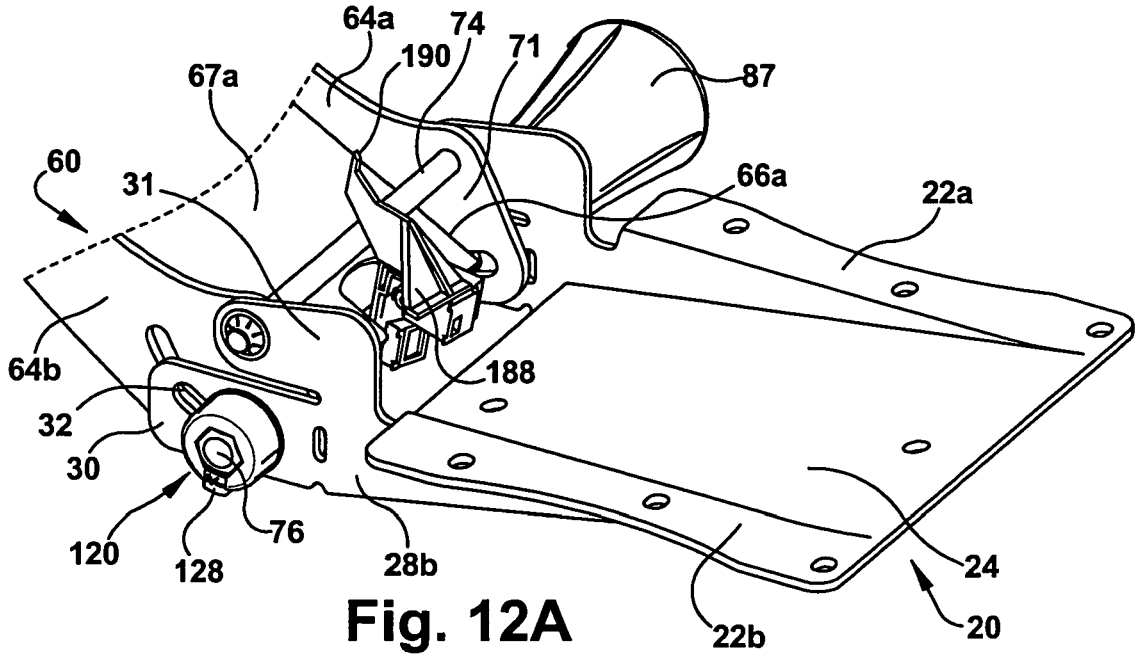
FIG. 12A is a perspective view of a tilt lockout member of the keyboard support of FIG. 1 in a position allowing positive tilt of the keyboard engaging member.
Figure 12B:
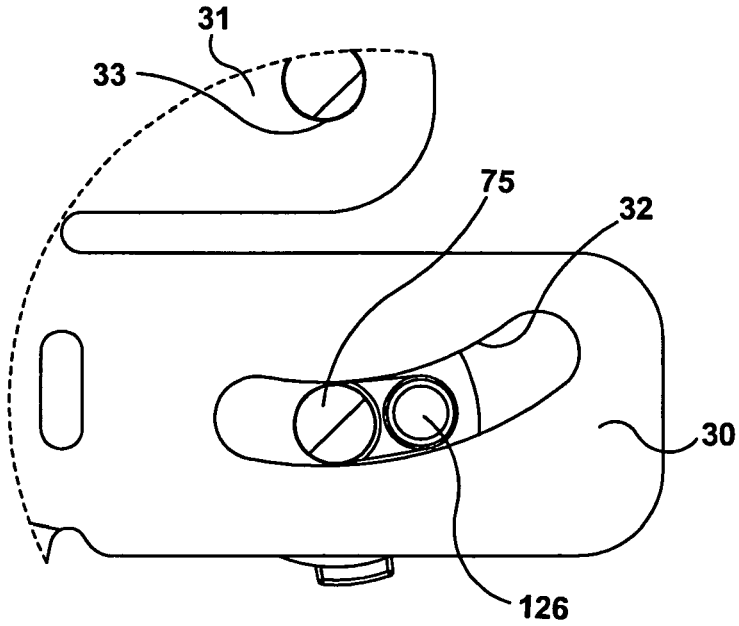
FIG. 12B is a side elevation view of an arm of the tilt lockout member in a position allowing positive tilt of the keyboard engaging member.

As can be seen in FIGS. 12A and 12B, when the tilt lockout member 120 is positioned with respect to the rod 75 such that the arm 126 extends into the arcuate slot 32 rearwardly of the rod 75, the tilt lockout member 120 is in the non lockout position and the angle of tilt of the keyboard engaging member 20 will vary (by rotation of the tilt knob 87) between +10° and −15°.

To move the tilt lockout member 120 from one position to the other, the tilt knob 87 is sufficiently loosened, such that a distance between tilt lockout member 120 and the finger 31 is sufficient to allow the arm 126 of the tilt lockout member 120 clear the arcuate slot 32 which is achieved by pulling on the tilt lockout member 120 outward to the left (shown as HL in FIG. 1) against the force of the bias spring 85. Then the tilt lockout member 120 is rotated with the hex head 76 of the rod 75 appropriately to either the lockout or non lockout position, as desired.

To make it easier for the user to determine whether the tilt lockout member 120 is in the lockout position or the non-lockout position, the tilt lockout member 120 includes a raised peripheral portion 128 with indicia. When the raised peripheral portion 128 is oriented upwardly (FIG. 13A), the tilt lockout member 120 is in the lockout position. When the raised peripheral portion 128 is oriented downwardly (FIG. 12A), the tilt lockout member 120 is in the non-lockout position.

Tilt Gauge Assembly 140

The keyboard support of the present invention includes a tilt gauge assembly 140 which provides the user an easily readable indication of the current tilt angle of the keyboard 12. As can best be seen in FIGS. 17, 18, 19, 20A and 28B, one exemplary embodiment of the tilt gauge assembly 140 includes a cover 142 and a parallelogram linkage 144 affixed thereto. The cover 142, in addition to supporting the parallelogram linkage 144, protects the linkage assembly 60 from debris and presents an attractive appearance to the assembled keyboard support 10.

The cover 142 is sized to fit firmly in position over the side pieces 28*a,* 28*b* of the keyboard engaging member 20 and includes a pair of forwardly extending ears 146 extending from opposite sides of the cover which fit snugly against the side pieces 28*a,* 28*b* and under the rearward portion of the keyboard support surfaces 22*a,* 22*b*. A J-shaped hook 148 extends downwardly from an inner surface 150 of a top side 152 the cover 142 and snap fits over the rod 74 to hold the cover in place.

The parallelogram linkage 144 includes a base 154 that is anchored to and extends through a slotted opening 156 in a front side 158 of the cover 142. Extending from the base are spaced apart horizontal beams, a bottom beam 162 and a top beam 164. The bottom beam 162 comprises a lower portion 174 of a stationary member 166 and a lower portion 176 of an offset movable member 168 coupled by a lower pivot member 170. The stationary member 166 is stationary with respect to the base 154, while the movable member 168 is movable with respect to the base 154. The top beam 164 comprises an upper portion 178 of the stationary member 166 and an upper portion 180 of the movable end member 168 coupled by an upper pivot member 172.

The lower pivot member 170 is pivotally connected by a hinge at one end to the lower portion 174 of the stationary member 166 and is pivotally connected by a hinge at an opposite end to the lower portion 176 of the movable end member 168. The upper pivot member 172 is pivotally connected by a hinge at one end to the upper portion 178 of the stationary member 166 and is pivotally connected by a hinge at an opposite end to the upper portion 180 of the movable end member 168.

A rearward face 182 of the movable end member 168 abuts and bears against the threaded rod 75. A biasing spring 184 coupled to a horizontally extending arm 186 of the upper pivot member 172 biases the movable end member 168 rearwardly against the threaded rod. As the planar keyboard support rest 26 of the keyboard engaging member 20 is tilted with respect to the desk 14, the workstation engaging member 40 and the threaded rod 75 remain stationary. Since the stationary member 166 is mounted to the cover 142 and since the cover is mounted to the keyboard engaging member 20, the stationary member 166 pivots with the keyboard engaging member 20 about the rod 74. However, the movable end member 168 abuts the threaded rod 75. The threaded rod 75 does not move when the tilt angle of the keyboard engaging member 20 is changed. The movable end member 168 slides and rotates relative to the threaded rod 75, however, the movable end member 168 remains tangent to the cylindrical outer surface of the threaded rod 75 at all times. Thus, a dynamic line of contact between the movable end member 168 and the threaded rod 75 does not move radially forward or rearward with respect to the rod 75. Accordingly, changing the angle of tilt of the keyboard engaging member 20 causes a distance between the stationary member 166 and the movable end member 168 (along a longitudinal axis L-L of the parallelogram 144) to change. Changing the distance between the stationary member 166 and the movable end member 168 causes the upper and lower pivot members 172, 170 to pivot on their respective hinges.

Extending from the upper pivot member 172 is an upwardly angled arm 188 terminating in a pointer needle 190. The pointer needle 190 extends through a slotted opening 192 in the top side 152 of the cover 142. As the tilt angle of the keyboard engaging member 20 changes, as explained above, due to the geometry of the parallelogram linkage 144, the upper pivot member 172 pivots (as does, of course, the lower pivot member 170). As the upper pivot member 172 pivots, the pointer needle 190 moves along the arcuate slotted opening 192. Tilt angle indicia 194 are printed along an edge of the slotted opening 192 to indicate the angle of tilt. To read the tilt angle, the user merely glances at the position of the pointer needle 190 and reads the value from the indicia 194 that is aligned with the pointer needle 190. The value of indicia aligned with the needle 190 corresponds to the present tilt angle of the keyboard engaging member 20. Basically, the tilt gauge assembly 140 converts the longitudinal movement of the movable end member 168 resulting from contact with the threaded rod 75 as the tilt angle is changed into an angular deflection of the needle 190.

It is appreciated that while a preferred embodiment of the invention has been described, it is the intent that the invention include all modifications and alterations from the disclosed design falling within the spirit or scope of the appended claims.

We claim:

1. A keyboard support for movably supporting a keyboard with respect to a work surface of a workstation, the keyboard support comprising:

a) a workstation engaging member adapted to be attached to an underside of the work surface;

b) a keyboard engaging member disposed forwardly of the workstation engaging member for supporting a keyboard and including a side defining a slot and a hole;

c) a linkage assembly mechanically coupling and providing relative movement between the workstation engaging member and the keyboard engaging member, the linkage assembly including:

1) an upper support member including one end rotatably mounted to the workstation engaging member and further including an arcuate slot and a hole at an opposite end;

2) a lower support member including one end rotatably mounted to the workstation engaging member and further including a hole at an opposite end;

3) a lower connector passing through the arcuate slot in the upper support member, the slot of the keyboard engaging member, and the hole of the lower support member; and 4) an upper connector passing through the hole of the keyboard engaging member and the hole of the upper support member;

d) a braking assembly adapted to allow relative movement of the keyboard engaging member with respect to the workstation engaging member in an unlocked position and to prevent relative movement of the keyboard engaging member with respect to the workstation engaging member in a locked position, the braking assembly including:

1) an inclined surface on the side of the keyboard engaging member and including a slot aligned with the arcuate slot of the one side of the keyboard engaging member, the inclined surface extending rearwardly from a higher end spaced further outwardly from the keyboard engaging member side to a lower end, the inclined surface slot extending along the inclined surface from near the higher end towards the lower end, the lower connector extending through the inclined surface slot;

2) a roller assembly carried on the lower connector and including a roller, the roller assembly being biased against the inclined surface for adjusting a frictional force between the upper and lower support members, as the roller assembly is urged further outwardly from the keyboard engaging member side, a force applied by the roller assembly against the inclined surface increasing and the frictional force between the upper and lower support members increasing;

e) as a forwardly extending end of the keyboard engaging member is pivoted downwardly about the upper connector, the inclined surface moving rearwardly, the roller rolling along the inclined surface and the roller assembly moving outwardly with respect to the keyboard engaging member side resulting in increased frictional force between the upper and lower support members and thereby preventing relative movement between the keyboard engaging member and the workstation engaging member, the braking assembly being in the locked position; and f) as the forwardly extending end of the keyboard engaging member is pivoted upwardly about the upper connector, the inclined surface moving forwardly, the roller rolling along the inclined surface and the roller assembly moving closer to the keyboard engaging member side resulting in reduced frictional force between the upper and lower support members and thereby permitting relative movement between the keyboard engaging member and the workstation engaging member, the braking assembly being in the unlocked position.

2. The keyboard support of claim 1 wherein the inclined surface comprises a wedge affixed to the side of the keyboard engaging member.

3. The keyboard support of claim 1 wherein the side of the keyboard engaging member is substantially vertical.

4. The keyboard support of claim 1 wherein the keyboard engaging member includes first and second spaced apart substantially vertical sides separated by a center section, each of the first and second sides defining horizontally aligned slots and aligned holes, the lower connector passing through the arcuate slot in the upper support member, the aligned slots of the keyboard engaging member, and the hole passing through the lower support member; and the upper connector passing through the aligned holes of the keyboard engaging member and the hole of the upper support member.

5. The keyboard support of claim 1 wherein the roller assembly includes a pair of rollers mounted to a hub, the hub being rotatably mounted to the lower connector, the pair of rollers rolling along the inclined surface as the forwardly extending end of the keyboard engaging member is pivoted.

6. The keyboard support of claim 1 wherein the roller assembly is biased against the wedge by a spring disposed between the roller assembly and a tilt adjustment knob threaded onto a threaded end of the lower connector.

7. The keyboard support of claim 6 wherein the spring is disposed between the tilt adjustment knob and a hub of the roller assembly, the roller being mounted to the hub.

8. The keyboard support of claim 7 wherein turning the tilt adjustment knob in a direction that causes the knob to be further threaded onto the threaded end of the lower connector tilts the forwardly extending end of the keyboard engaging member support upwardly.

9. The keyboard support of claim 8 wherein turning the tilt adjustment knob in a direction that causes the knob to be unthreaded from the threaded end of the lower connector tilts the forwardly extending end of the keyboard engaging member support downwardly.

10. The keyboard support of claim 1 further including a tilt gauge assembly to provide a visual indication of a tilt angle of the keyboard engaging member, the tilt gauge assembly including a stationary member affixed to the keyboard engaging member that pivots with the keyboard engaging member with respect to the upper connector and a movable end member tangent to the lower connector wherein changing the tilt angle of the keyboard engaging member causes a distance between the stationary member and the movable end member to change.

11. The keyboard support of claim 10 wherein the tilt gauge assembly further includes a cover and an upper pivot member pivotally coupled between the stationary member and the movable end member, the upper pivot member including a pointer needle at a distal end of the upper pivot member extending through an arcuate opening of the cover, wherein changing the tilt angle of the keyboard engaging member causes the upper pivot member to pivot and move the pointer needle along the arcuate opening of the cover.

12. The keyboard support of claim 11 wherein the cover includes tilt angle indicia along an edge of the cover adjacent the arcuate opening and a position of the pointer needle along the arcuate opening of the cover provides a visual indication of the tilt angle of the keyboard engaging member.

13. A braking assembly in combination with a keyboard support comprising:

a keyboard support including a workstation engaging member; a keyboard engaging member disposed forwardly of the workstation engaging member for supporting a keyboard and including a side defining a slot and a hole; and a linkage assembly mechanically coupling and providing relative movement between the workstation engaging member and the keyboard engaging member wherein the linkage assembly includes an upper support member including one end rotatably mounted to the workstation engaging member and further including an arcuate slot and a hole at an opposite end; a lower support member including one end rotatably mounted to the workstation engaging member and further including a hole at an opposite end; a lower connector passing through the arcuate slot in the upper support member, the slot of the keyboard engaging member, and the hole of the lower support member; and an upper connector passing through the hole of the keyboard engaging member and the hole of the upper support member;

a braking assembly including:

an inclined surface on the side of the keyboard engaging member and including a slot aligned with the arcuate slot of the keyboard engaging member, the inclined surface extending rearwardly from a higher end spaced further outwardly from the keyboard engaging member side to a lower end, the inclined surface slot extending along the inclined surface from near the higher end towards the lower end, the lower connector extending through the inclined surface slot;

a roller assembly supported by the lower connector and including a roller, the roller assembly being biased against the inclined surface for adjusting a frictional force between the upper and lower support members, as the roller assembly is urged further outwardly from the keyboard engaging member side, a force applied by the roller assembly against the inclined surface increasing and the frictional force between the upper and lower support members increasing;

as a forwardly extending end of the keyboard engaging member is pivoted downwardly about the upper connector, the inclined surface moving rearwardly, the roller rolling along the inclined surface and the roller assembly moving outwardly with respect to the keyboard engaging member side resulting in increased frictional force between the upper and lower support members and thereby preventing relative movement between the keyboard engaging member and the workstation engaging member, the braking assembly being in a locked position; and as the forwardly extending end of the keyboard engaging member is pivoted upwardly about the upper connector, the inclined surface moving forwardly, the roller rolling along the wedge and the roller assembly moving closer to the keyboard engaging member side resulting in reduced frictional force between the upper and lower support members and thereby permitting relative movement between the keyboard engaging member and the workstation engaging member, the braking assembly being in a unlocked position.

14. The combination of claim 13 wherein the inclined surface comprises a wedge affixed to the side of the keyboard engaging member.

15. The combination of claim 13 wherein the roller assembly includes a pair of rollers mounted to a hub, the hub being rotatably mounted to the lower connector, the pair of rollers rolling along the inclined surface as the forwardly extending end of the keyboard engaging member is pivoted.

16. The combination of claim 13 wherein the roller assembly is biased against the wedge by a spring disposed between the roller assembly and a tilt adjustment knob threaded onto a threaded end of the lower connector.

17. The combination of claim 16 wherein the spring is disposed between the tilt adjustment knob and a hub of the roller assembly, the roller being mounted to the hub.

* * * * *